US007822369B2

(12) United States Patent
Koyama

(10) Patent No.: US 7,822,369 B2
(45) Date of Patent: Oct. 26, 2010

(54) DEVELOPER SUPPLYING APPARATUS

(75) Inventor: Kazuya Koyama, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 1051 days.

(21) Appl. No.: 11/544,678

(22) Filed: Oct. 10, 2006

(65) Prior Publication Data

US 2007/0092302 A1 Apr. 26, 2007

(30) Foreign Application Priority Data

Oct. 7, 2005 (JP) ..... 2005-295765

(51) Int. Cl.
*G03G 15/08* (2006.01)

(52) U.S. Cl. ..... 399/260; 399/262

(58) Field of Classification Search ..... 399/106, 399/258, 260, 262, 119, 120
See application file for complete search history.

(56) References Cited

U.S. PATENT DOCUMENTS

| | | | | |
|---|---|---|---|---|
| 5,455,662 | A | 10/1995 | Ichikawa et al. | |
| 5,500,719 | A | 3/1996 | Ichikawa et al. | |
| 5,627,631 | A | 5/1997 | Ichikawa et al. | |
| 5,669,044 | A | 9/1997 | Cuthbert | |
| 5,822,663 | A | 10/1998 | Ichikawa et al. | |
| 5,890,040 | A | 3/1999 | Matsuoka et al. | |
| 5,918,090 | A | 6/1999 | Ichikawa et al. | |
| 5,923,931 | A | 7/1999 | Kishimoto | |
| 5,966,574 | A | 10/1999 | Ui et al. | |
| 6,075,963 | A | 6/2000 | Ichikawa et al. | |
| 6,289,195 | B1 | 9/2001 | Ichikawa et al. | |
| 6,766,135 | B2 | 7/2004 | Wang et al. | |
| 7,245,852 | B2 | 7/2007 | Takuwa | |
| 7,447,470 | B2 * | 11/2008 | Lee | 399/262 |
| 7,561,821 | B2 * | 7/2009 | Koyama et al. | 399/106 |
| 2002/0001485 | A1 | 1/2002 | Ichikawa et al. | |
| 2003/0138273 | A1 | 7/2003 | Ichikawa et al. | |

(Continued)

FOREIGN PATENT DOCUMENTS

JP 6-348127 12/1994

(Continued)

OTHER PUBLICATIONS

U.S. Appl. No. 11/544,042, filed Oct. 6, 2006, Inventor: Koyama et al.

(Continued)

*Primary Examiner*—David M Gray
*Assistant Examiner*—Gregory H Curran
(74) *Attorney, Agent, or Firm*—Nixon & Vanderhye PC

(57) ABSTRACT

A developer supplying apparatus of the present invention includes a toner bottle, a bottle supporting member that is in the shape of substantially a cylinder, and a shutter mechanism for opening and closing a toner discharging opening formed on the bottle supporting member. The shutter mechanism includes (i) a shutter member which is slidably provided on the bottle supporting member and opens/closes the toner discharging opening, and (ii) a protruding portion which is provided on the toner bottle, and when the shutter member is located at such a position that the toner discharging opening is closed, engages with a part of the shutter member so as to stop rotation of the toner bottle. Thus, it is possible to realize the developer supplying apparatus which can stably supply a toner to a development device at high speed.

7 Claims, 22 Drawing Sheets

U.S. PATENT DOCUMENTS

| | | | |
|---|---|---|---|
| 2003/0156860 | A1 | 8/2003 | Nakamura |
| 2004/0022559 | A1 | 2/2004 | Kusano et al. |
| 2004/0161267 | A1 | 8/2004 | Ichikawa et al. |
| 2004/0190945 | A1 | 9/2004 | Yamadu |
| 2004/0265012 | A1 | 12/2004 | Hasehe |
| 2006/0133856 | A1 | 6/2006 | Deguchi et al. |

FOREIGN PATENT DOCUMENTS

| | | |
|---|---|---|
| JP | 8-339115 | 12/1996 |
| JP | 2001-134055 | 5/2001 |
| JP | 2003-57930 | 2/2003 |
| JP | 2004-170553 | 6/2004 |

OTHER PUBLICATIONS

U.S. Appl. No. 11/544,676, filed Oct. 10, 2006, Inventor: Koyama et al.

U.S. Office Action mailed Feb. 23, 2009 in related U.S. Appl. No. 11/544,042.

U.S. Office Action mailed Apr. 15, 2009 in related U.S. Appl. No. 11/544,676.

* cited by examiner

DEVELOPER SUPPLYING APPARATUS

This Nonprovisional application claims priority under 35U.S.C. §119(a) on Patent Application No. 295765/2005 filed in Japan on Oct. 7, 2005, the entire contents of which are hereby incorporated by reference.

FIELD OF THE TECHNOLOGY

The present technology relates to a developer supplying apparatus which supplies a developer(s) to a developing device.

BACKGROUND OF THE TECHNOLOGY

For example, disclosed in Document 1 is a developer supplying apparatus which supplies a developer(s) to a developing device included in an image forming apparatus such as a printer or a copy machine.

In the developer supplying apparatus disclosed in Document 1, a toner(s) (developer(s)) contained in a toner cartridge (developer container) is conveyed to a predetermined position with a screw provided in the toner cartridge.

However, in order to convey a large amount of toner, it is necessary to increase the size of a toner cartridge main body so that the screw will not be loaded. That is, the problem is that the amount of toner that the toner cartridge can contain is small.

Here, each of Documents 2 to 4 discloses a technique for conveying, without using the screw, the toner, contained in the toner cartridge, to a desired position by causing the toner cartridge itself to rotate.

According to this technique, the toner is conveyed by the rotation of the toner cartridge itself. Therefore, it is not necessary to provide in the toner cartridge the screw for conveying the toner. On this account, it is not necessary to consider the load of the screw. Therefore, it is possible to increase the amount of toner contained in the toner cartridge.

However, according to the technique disclosed in each of Documents 2 to 4, the toner is directly discharged from the toner cartridge. Therefore, the toner cannot be discharged stably depending on the amount of toner contained, the number of rotations of the toner cartridge, etc. That is, the problem is that the toner cannot be supplied to the developing device stably.

Here, disclosed in Document 5 is a developer storage container in which (i) a container for temporarily containing the toner discharged from the toner cartridge is provided and (ii) the toner is supplied to the developing device from this container. In this case, even in the case of a configuration of discharging the toner by the rotation of the toner cartridge main body, it is possible to supply the toner to the developing device stably.

Document 1

Japanese Unexamined Patent Publication No. 142936/1998 (Tokukaihei 10-142936 (published on May 29, 1998)

Document 2

Japanese Unexamined Patent Publication No. 20705/1995 (Tokukaihei 7-20705 (published on Jan. 24, 1995) Document 3

Japanese Unexamined Patent Publication No. 339115/1996 (Tokukaihei 8-339115 (published on Dec. 24, 1996)

Document 4

Japanese Unexamined Patent Publication No. 348127/1994 (Tokukaihei 6-348127 (published on Dec. 22, 1994)

Document 5

Japanese Unexamined Patent Publication No. 317592/2004 (Tokukai 2004-317592 (published on Nov. 11, 2004)

However, the problem of the technique disclosed in Document 5 is that it is impossible to print in large quantities at high speed. Reasons for this are as follows.

This is because, according to the technique disclosed in Document 5, the toner is conveyed so as to gather at a center portion of a cartridge main body, and then supplied to a development device. That is, in order to print in large quantities at high speed, it is necessary to stably supply the toner to the development device at high speed. Therefore, in the case where the toner is conveyed so as to gather at the center portion of the cartridge main body as in Document 5, it takes time until the toner gathers at the center portion of the cartridge main body. On this account, it is difficult to stably supply the toner to the development device at high speed.

SUMMARY OF THE TECHNOLOGY

An object of the present technology's to provide a developer supplying apparatus which can stably supply a toner(s) to a development device at high speed.

In order to achieve the above-described object, a developer supplying apparatus is so configured as to be a developer supplying apparatus for supplying a developer to a developing device and as to include (I) a developer container which contains the developer and is in the shape of substantially a cylinder and (II) a container supporting body which supports one end portion of the developer container so that the developer container is able to rotate in a peripheral surface direction, the developer container including (i) a first developer discharging opening for discharging the developer, the first developer discharging opening being formed on the above-described one end portion, supported by the container supporting body, of the developer container and (ii) developer conveying means for conveying the developer toward the first developer discharging opening by rotation of the developer container in the peripheral surface direction, the container supporting body including (i) a temporary storage chamber for temporarily storing the developer discharged from the first developer discharging opening of the developer container and (ii) a second developer discharging opening for discharging the developer toward the developing device, and the developer contained in the temporary storage chamber being discharged from the second developer discharging opening by the rotation of the developer container. The developer supplying apparatus is so configured as to further include a shutter mechanism for opening and closing the second developer discharging opening, the shutter mechanism including (i) a shutter member which is slidably provided on the container supporting body and opens/closes the second developer discharging opening, and (ii) a hook portion which is provided on the developer container, and when the shutter member is located at such a position that the second developer discharging opening is closed, engages with a part of the shutter member so as to stop the rotation of the developer container.

According to the above-described configuration, the developer contained in the developer container that is in the shape of substantially a cylinder is first conveyed toward the container supporting body by the rotation of the developer container in the peripheral surface direction. Since the first developer discharging opening is formed on the above-described one end portion, supported by the container supporting body, of the developer container, the developer is conveyed toward the first developer discharging opening by the rotation of the developer container in the peripheral surface direction, and is discharged from the first developer discharging opening.

Next, the developer having been discharged from the first developer discharging opening is stored in the temporary storage chamber of the container supporting body. Then, the developer is discharged from the second developer discharging opening of the container supporting body toward the developing device by the rotation of the developer container.

Since the developer is discharged from the above-described one end portion of the developer container, the developer can be discharged from the first developer discharging opening more quickly than a case of gathering the developer, contained in the developer container, at a center portion of the developer container.

In addition, after the developer discharged from the first developer discharging opening is temporarily stored in the temporary storage chamber of the container supporting body, it is supplied to the developing device from the second developer discharging opening. Therefore, it is possible to supply the developer stably.

Therefore, it is possible to realize the developer supplying apparatus which can stably supply the developer to the development device at high speed.

In addition, the developer supplying apparatus includes the shutter mechanism, for opening and closing the second developer discharging opening, including (i) the shutter member which is slidably provided on the container supporting body and opens/closes the second developer discharging opening, and (ii) the hook portion which is provided on the developer container, and when the shutter member is located at such a position that the second developer discharging opening is closed, engages with a part of the shutter member so as to stop the rotation of the developer container. Therefore, when the second developer discharging opening of the developer supplying apparatus is closed, it is possible to stop the rotation of the developer container.

Thus, it is possible to prevent the developer leakage caused by the rotation of the developer container, for example, when carrying the developer supplying apparatus.

Moreover, when the shutter member is located at such a position that the second developer discharging opening is open, engagement of the hook portion with the part of the shutter member is canceled. Therefore, when the second developer discharging opening of the developer supplying apparatus is open, the developer container is rotatable.

The developer supplying apparatus is detachably attached to an image forming apparatus. When the developer supplying apparatus is attached to the image forming apparatus, the shutter member may slide to such a position that the second developer discharging opening is open.

The shutter member may have a regulating member which, when the developer supplying apparatus is attached to an image forming apparatus and the shutter member slides, (i) engages with a protruding portion formed on an attachment portion of the image forming apparatus and (ii) keeps the second developer discharging opening open. Moreover, the regulating member may have a claw portion which (i) when the shutter member slides in such a direction that the second developer discharging opening is open, engage with the protruding portion and (ii) when a predetermined moving force or more is applied, goes over the protruding portion.

When the claw portion has gone over the protruding portion, the claw portion may regulate sliding of the shutter member in such a direction that the second developer discharging opening is closed.

The claw portion may include (i) a rib-like first hook portion which first contacts the protruding portion when the shutter member slides in such a direction that the second developer discharging opening opens and (ii) a plate-like second hook portion which contacts the protruding portion after the first hook portion and has elasticity.

The container supporting body may be formed by detachably attaching a first case and a second case each other.

Thus, it is possible to easily assemble the developer supplying apparatus, and also possible to do maintenance of the developer supplying apparatus easily since expendable supplies such as seals can be easily replaced for recycling.

Additional objects, features, and strengths will be made clear by the description below. Further, the advantages will be evident from the following explanation in reference to the drawings.

BRIEF DESCRIPTION OF THE DRAWINGS

FIG. 1(*b*) is a front view of the developer supplying apparatus.

FIG. 9(*b*) shows the bottle supporting member shown in FIG. 8, and is a perspective view of a second case constituting the bottle supporting member.

FIG. 14(*b*) is a back view of the bottle supporting member of the developer supplying apparatus, and is a diagram showing the toner discharging opening that is closed by a shutter member.

FIG. 16(*b*) is a perspective view of a backside of the shutter mechanism.

FIG. 17(*b*) is a diagram for explaining the relationship between the shutter mechanism and the rotation of the toner bottle.

FIG. 21(*b*) is a diagram showing the positional relationship between the regulating member and the protruding portion when the developer supplying apparatus is attached to the attachment mount.

FIG. 21(*c*) is a diagram showing the positional relationship between the regulating member and the protruding portion when the developer supplying apparatus is about to be detached from the attachment mount.

DESCRIPTION OF THE EMBODIMENTS

The following will explain one embodiment of the technology. Note that the present embodiment will explain an example in which a developer supplying apparatus is applied to a printer that is a kind of image forming apparatus.

Figure 2:
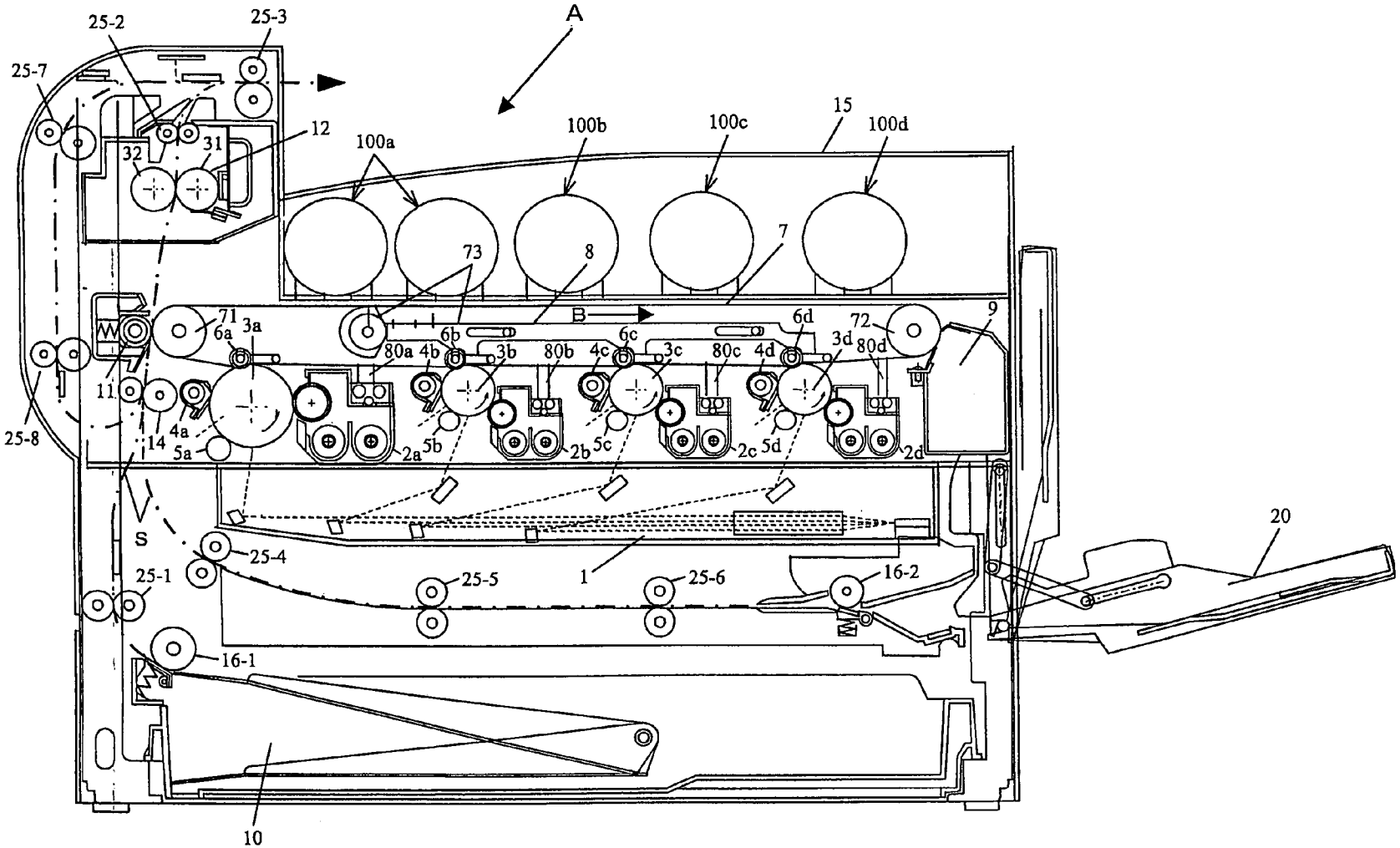
FIG. 2 is a schematic configuration diagram showing a printer that is one example of an image forming apparatus including the developer supplying apparatus shown in FIG. 1.

FIG. 2 is a diagram showing a schematic configuration of the printer of the present embodiment.

A printer (A) forms a multicolor image or a unicolor image on a predetermined sheet (recording sheet) in accordance with image data supplied externally. Then, as shown in FIG. 2, the printer (A) includes an exposure unit 1, a developing device 2, a photosensitive drum 3, a charger 5, a cleaner unit 4, an intermediate transfer belt unit 8, a fixing unit 12, a sheet conveying path S, a paper feed tray 10, a paper output tray 15, etc.

Note that the image data that the printer (A) handles corresponds to a color image using black (K), cyan (C), magenta (M), and yellow (Y). Therefore, four developing devices 2 (2*a*, 2*b*, 2*c*, and 2*d*), four photosensitive drums 3 (3*a*, 3*b*, 3*e*, and 3*d*), four chargers 5 (5*a*, 5*h*, 5*c*, and 5*d*), and four cleaner units 4 (4*a*, 4*b*, 4*e*, and 4*d*) are provided for forming four kinds of latent images corresponding to respective colors. Then, "a" corresponds to black, "b" corresponds to cyan, "c" corresponds to magenta, and "d" corresponds to yellow. Thus, four image stations are formed.

The photosensitive drums 3 are provided at (attached to) an upper portion of the printer (A), and form electrostatic latent images corresponding to the image data.

The chargers 5 are charging means for uniformly charging the surfaces of the photosensitive drums 3 at a predetermined potential. Note that the chargers 5 may be a contact-type roller charger as shown in FIG. 2, a contact-type brush charger, or a non-contact-type charger.

As shown in FIG. 2, the exposure unit 1 is a laser scanning unit (LSU) including a laser irradiating section and reflection mirrors. Other than using the LSU as the exposure unit 1, it may be possible to use, for example, an EL or LED writing head in which light emitting elements are arranged in an array.

The exposure unit 1 exposes the charged photosensitive drums 3 in accordance with the input image data. Thus, electrostatic latent images corresponding to the image data are formed on the surfaces of the photosensitive drums 3.

The developing devices 2 visualize, using the toners (K, C, M, and/or Y), the electrostatic latent images formed on the photosensitive drums 3. The cleaner units 4 remove and collect the toners remaining on the surfaces of the photosensitive drums 3 after the development/the image transfer.

The intermediate transfer belt unit 8 provided above the photosensitive drums 3 includes an intermediate transfer belt 7, an intermediate transfer belt driving roller 71, an intermediate transfer belt tension mechanism 73, an intermediate transfer belt driven roller 72, intermediate transfer rollers 6 (6*a*, 6*b*, 6*c*, and 6*d*), and an intermediate transfer belt cleaning unit 9.

The intermediate transfer belt driving roller 71, the intermediate transfer belt tension mechanism 73, the intermediate transfer rollers 6, the intermediate transfer belt driven roller 72, etc. are for stretching the intermediate transfer belt 7 and causing the intermediate transfer belt 7 to rotate in an arrow B direction.

The intermediate transfer rollers 6 are rotatably supported by intermediate transfer roller attaching portions of the intermediate transfer belt tension mechanism 73 of the intermediate transfer belt unit 8, and apply transfer bias for causing toner images on the photosensitive drums 3 to transfer to the intermediate transfer belt 7.

The intermediate transfer belt 7 is provided so as to contact the photosensitive drums 3, and respective color toner images formed on the photosensitive drums 3 are sequentially transferred to the intermediate transfer belt 7 in an overlapping manner. Thus, a color toner image (multicolor toner image) is formed on the intermediate transfer belt 7. The intermediate transfer belt 7 is formed by an endless film having a thickness of about 100 μm to 150 μm.

The transfer of the toner images from the photosensitive drums 3 to the intermediate transfer belt 7 is carried out by the intermediate transfer rollers 6 which contact the backside of the intermediate transfer belt 7. In order to transfer the toner images, a high voltage transfer bias (a high voltage whose polarity (+) is opposite the polarity (−) of the toner) is applied to each of the intermediate transfer rollers 6.

Each of the intermediate transfer rollers 6 is a roller formed by covering, with a conductive elastic material (for example, EPDM, urethane foam, etc.), the surface of a metal (for example, stainless steel) axis used as a base and having a diameter of 8 mm to 10 mm. Because of this conductive elastic material, it is possible to uniformly apply the high voltage to the intermediate transfer belt 7. In the present embodiment, used as a transfer electrode is the roller. However, other than the roller, a brush, etc. can also be used as the transfer roller.

As described above, visualized electrostatic images, corresponding to respective hues, on the respective photosensitive drums 3 are stacked on the intermediate transfer belt 7, and the resulting image becomes image information input to the apparatus. Thus, the stacked image information is transferred onto a sheet (will be described later) by the rotation of the intermediate transfer belt 7 and the rotation of a transfer roller 11 provided at a position where the sheet and the intermediate transfer belt 7 contact each other.

Here, the intermediate transfer belt 7 contacts the transfer roller 11 at a predetermined nip, and a voltage (a high voltage whose polarity (+) is opposite the polarity (−) of the toner) for transferring the toner to the sheet is applied to the transfer roller 11.

Further, in order to secure the above-described nip constantly, either one of the transfer roller 11 and the intermediate transfer belt driving roller 71 is made of a hard material (metal, etc.), and the other one is made of a soft material, for example, an elastic roller (an elastic rubber roller, a foaming resin roller, etc.).

Moreover, as described above, the toner adhered to the intermediate transfer belt 7 by contacting the photosensitive drums 3, or the toner remaining on the intermediate transfer belt 7 since the toner is not transferred to the sheet by the transfer roller 11 is a cause of a toner color mixture in the following step. Therefore, the intermediate transfer belt cleaning unit 9 removes and collects the toner on the intermediate transfer belt 7.

The intermediate transfer belt cleaning unit 9 includes a cleaning blade as, for example, a cleaning member which contacts the intermediate transfer belt 7, and the intermediate transfer belt driven roller 72 supports the backside of the intermediate transfer belt 7 which contacts the cleaning blade.

The paper feed tray 10 is a tray for storing sheets (recording sheets) used for image formation, and is provided under an image forming section of the printer (A) and the exposure unit 1.

Moreover, the paper output tray 15 provided at an upper portion of the printer (A) is a tray for mounting printed sheets face-down.

Moreover, the printer (A) includes the sheet conveying path S which extends vertically and conveys the sheets in the paper feed tray 10 through the transfer roller 11 and the fixing unit 12 to the paper output tray 15. Further, a pickup roller 16, a resist roller 14, the transfer roller 11, a fixing section 12, conveying rollers 25 for conveying the sheets, etc. are provided in the vicinity of the sheet conveying path S from the paper feed tray 10 to the paper output tray 15.

Each of the conveying rollers 25 is a small roller for accelerating/assisting conveyance of the sheets, and these conveying rollers 25 are provided along the sheet conveying path S.

The pickup roller 16 is provided close to an edge portion of the paper feed tray 10, and is a roller which picks up the sheets one-by-one from the paper feed tray 10 and supplies them to the sheet conveying path S.

Moreover, the resist roller 14 is a roller which once holds the sheet which has been conveyed in the sheet conveying path S. Then, the resist roller 14 conveys the sheet to a transfer section at such a timing that the top edge of the toner image on the photosensitive drum 3 meets the top edge of the sheet.

The fixing unit 12 includes a heat roller 31, a pressure roller 32, etc. The heat roller 31 and the pressure roller 32 rotate while sandwiching the sheet.

Moreover, the heat roller 31 is set so as to have a predetermined fixation temperature by a control section in accordance with a signal from a temperature detecting device (not shown). Together with the pressure roller 33, the heat roller 31 carries out thermocompression bonding with respect to the sheet. Thus, the multicolor toner image transferred onto the sheet is melted, mixed, pressed, and fixed by heat on the sheet.

The sheet on which the multicolor toner image has been fixed is conveyed by the conveying roller 25 to a reverse paper output path of the sheet conveying path S. Thus, the sheet is output face-down to the paper output tray 15 (the surface on which the multicolor toner image is formed faces downward).

The following will explain a sheet conveyance path in detail. The image forming apparatus includes the paper feed tray 10 for storing the sheets in advance. Further, the image forming apparatus includes a manual paper feed tray 20 so that a user does not have to open and close the paper feed tray 10 when the user prints in small quantities.

For both paper feeding methods, the pickup rollers 16 are provided, respectively, and each of the pickup rollers 16 guides the sheets one-by-one to the conveyance path.

The sheet from the paper feed tray 10 is conveyed to the resist roller 14 by a conveying roller 25-1 provided along the conveyance path, the sheet is conveyed to the transfer roller 11 at such a timing that the top edge of the sheet meets the top edge of the image information on the intermediate transfer belt 7, and the image information is written on the sheet. Then, the sheet passes through the fixing section 12, so that an unfixed toner is melted and fixed by heat. Then, the sheet passes through the conveying roller 25-2 and a paper output roller 25-3, and then is output to the paper output tray 15.

When One-Side Printing is Requested

Meanwhile, the sheet on the manual paper feed tray 20 is picked up by the pickup roller 16-2. The sheet passes through a plurality of conveying rollers (25-6, 25-5, and 25-4), and reaches the resist roller 14. Then, the sheet follows the same procedure as the sheet from the paper feed tray 10, and then is output to the paper output tray 15 (when a one-side printing is requested).

When a two-side printing is requested, (i) the rear edge of the sheet having finished the above-described one-side printing and passed through the fixing section 12 is held by the paper output roller 25-3, (ii) the sheet is guided to the conveying roller (25-7, 25-8) by counter rotating of the paper output roller 25-3, (iii) the sheet passes through the resist roller 14 so that a printing is carried out with respect to the back surface of the sheet, and (iv) the sheet is output to the paper output tray 15.

In order to be able to print in large quantities at high speed, the printer (A) includes five developer supplying apparatuses 100 (100*a*, 100*a*, 100*b*, 100*c*, and 100*d*) for supplying the developers to the developing devices 2 (2*a*, 2*b*, 2*c*, and 2*d*), respectively.

Here, the developer supplying apparatus 100*a* stores a black (K) developer as a supplemental developer. The developer supplying apparatus 100*b* stores a cyan (C) developer as the supplemental developer. The developer supplying apparatus 100*c* stores a magenta (M) developer as the supplemental developer. The developer supplying apparatus 100*d* stores a yellow (Y) developer as the supplemental developer.

Then, the developer supplying apparatuses 100 are respectively provided substantially above the developing devices 2 which carry out development using the corresponding developers. Moreover, the developer supplying apparatuses 100 are respectively connected to the corresponding developing devices 2 via corresponding developer supplying pipes 80 (80*a*, 80*b*, 80*c*, and 80*d*).

Note that the developer supplying pipe 80*a* for supplying the black (K) developer is configured so as to collect the developers from two developer supplying apparatuses 100*a* and then supply the developers to the developing device 2*a*.

The following will explain detailed configurations of the developer supplying apparatuses 100. Note that five developer supplying apparatuses 100 have the same configuration.

Figure 1:
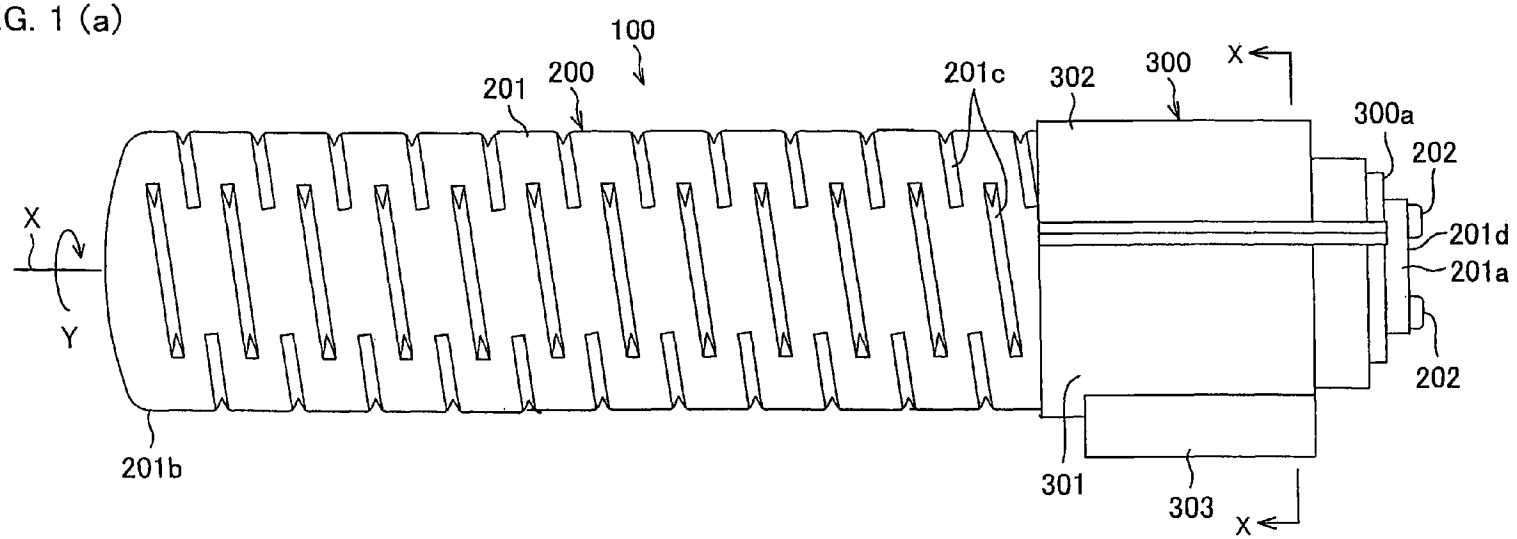
FIG. 1(*a*) is a side view of a developer supplying apparatus.
Figure 1:
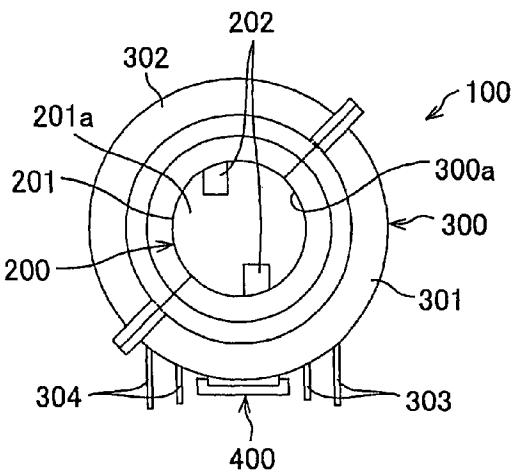

The following will explain an outline of the developer supplying apparatus 100 in reference to FIGS. 1(*a*) and 1(*b*).

FIG. 1(*a*) is a side view of the developer supplying apparatus 100, and FIG. 1(*b*) is a front view of the developer supplying apparatus 100 when viewed from one side from which the toner is supplied.

As shown in FIG. 1(*a*), the developer supplying apparatus 100 includes (i) a toner bottle (developer container) 200 which contains the toner that is the developer and (ii) a bottle supporting member (container supporting body) 300 which is attached to one end portion of the toner bottle 200 so as to rotatably support the toner bottle 200.

As shown in FIG. 1(*b*), a shutter mechanism 400 which opens and closes a toner discharging opening (second developer discharging opening (will be described later)) for discharging the toner, supplied from the toner bottle 200, to outside of the developer supplying apparatus 100 is provided on a bottom surface of the bottle supporting member 300 (a lower surface of the bottle supporting member 300 when the developer supplying apparatus 100 is attached to the printer (A)). That is, in the case where the toner discharging opening of the bottle supporting member 300 opens by the shutter mechanism 400, the toner discharging opening and the developer supplying pipe 80 connected to the developing device 2 shown in FIG. 2 are in communication with each other. Thus, the toner is supplied from the toner bottle 200 to the developing device 2.

The following will explain the toner bottle 200, the bottle supporting member 300, and the shutter mechanism 400 in detail.

As shown in FIG. 1(*a*), the toner bottle 200 includes a main body portion 201 which is in the shape of substantially a cylinder.

One end portion, which is supported by the bottle supporting member 300, of the main body portion 201 is termed a tip portion 201*a*. The tip portion 201*a* has an opening portion (first developer discharging opening (will be described later)) for discharging the toner. Note that another end portion opposite the tip portion 201*a* of the main body portion 201 is termed a rear portion 201*b* which is closed.

Moreover, a plurality of groove portions 201*c* are formed on the surface of the main body portion 201, and each of the groove portions 201*c* is concave toward a rotation axis X. Inside the main body portion 201, a portion corresponding to the groove portion 201*c* is a projecting portion which projects toward the rotation axis X.

A groove formed between the projecting portions functions as a guiding groove for guiding the toner, stored in the main body portion 201, from the rear portion 201*b* toward the tip portion 201*a*. That is, the grooves function as developer conveying means for conveying the toner (developer). Here, as shown in FIG. 1(*a*), the groove portion 201*c* is formed obliquely so that, when the main body portion 201 rotates in a Y direction (clockwise direction) centering on the rotation axis X, (i) a lower (direction of gravitational force) side of the groove portion 201*c* is inclined toward the tip portion 201*a* and (ii) an upper (direction opposite the direction of gravitational force) side of the groove portion 201*c* is inclined toward the rear portion 201*b*. Therefore, by the rotation of the toner bottle 200 in the Y direction, the toner stored in the toner bottle 200 is conveyed from the rear portion 201*b* of the main body portion 201 toward the tip portion 201*a*.

Note that the groove portion 201*c* may have any shape as long as the toner stored in the main body portion 201 can be conveyed from the rear portion 201*b* toward the tip portion 201*a*.

Figure 3:
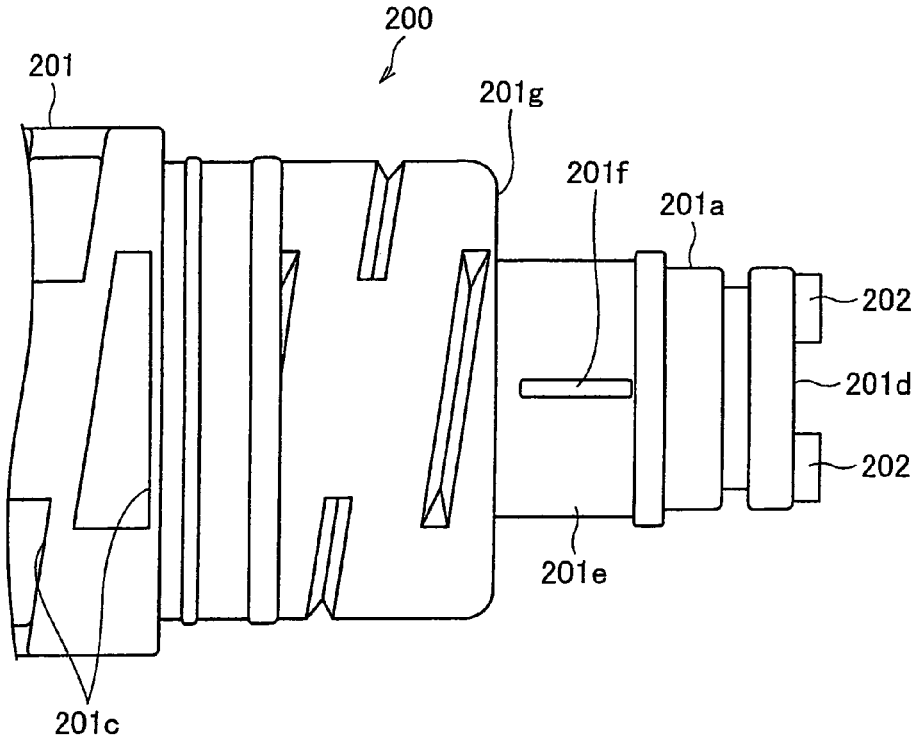
FIG. 3 is a side view of a tip portion of a toner bottle constituting the developer supplying apparatus.

As shown in FIG. 3, the tip portion 201*a* is in the shape of a cylinder whose diameter is smaller than that of a center portion of the main body portion 201. Ribs 202 are formed on a tip surface 201*d* of the tip portion 201*a*, and each of the ribs 202 projects outwardly. The ribs 202 fit a driving portion of a driving device (not shown) when the developer supplying apparatus 100 is attached to the printer (A). Therefore, the toner bottle 200 of the developer supplying apparatus 100 rotates by a driving force supplied from the driving portion via the ribs 202.

Figure 4:
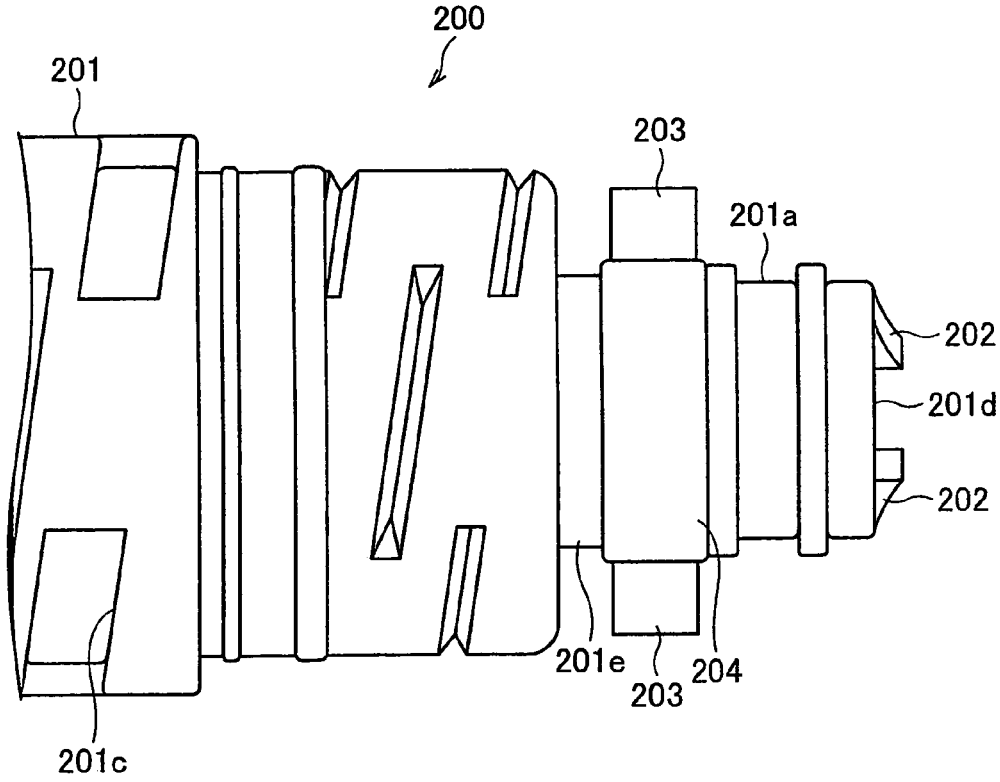
FIG. 4 is a side view of the tip portion, to which a scraper is attached, of the toner bottle constituting the developer supplying apparatus.
Figure 5:
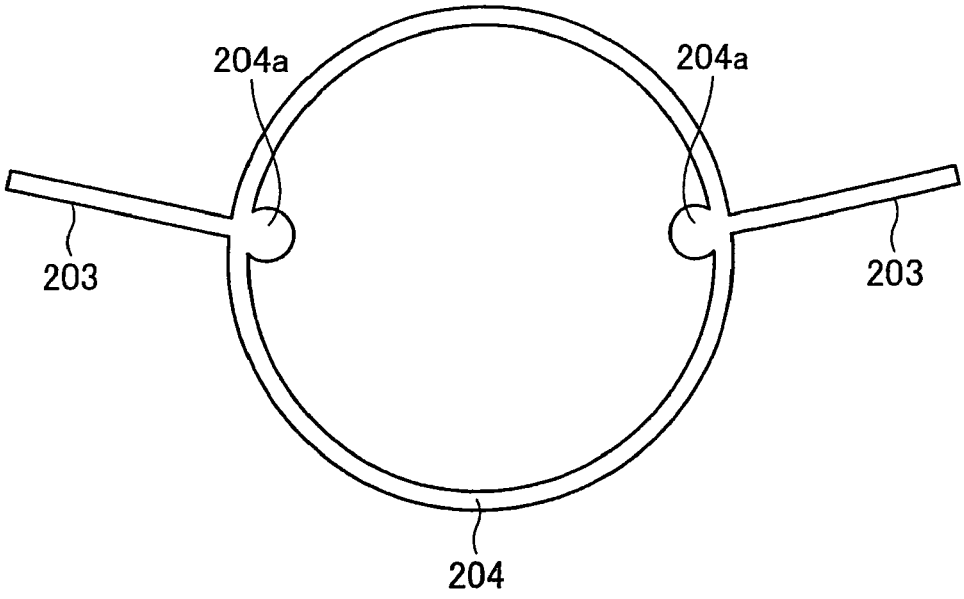
FIG. 5 is a diagram showing one example of the scraper.
Figure 6:
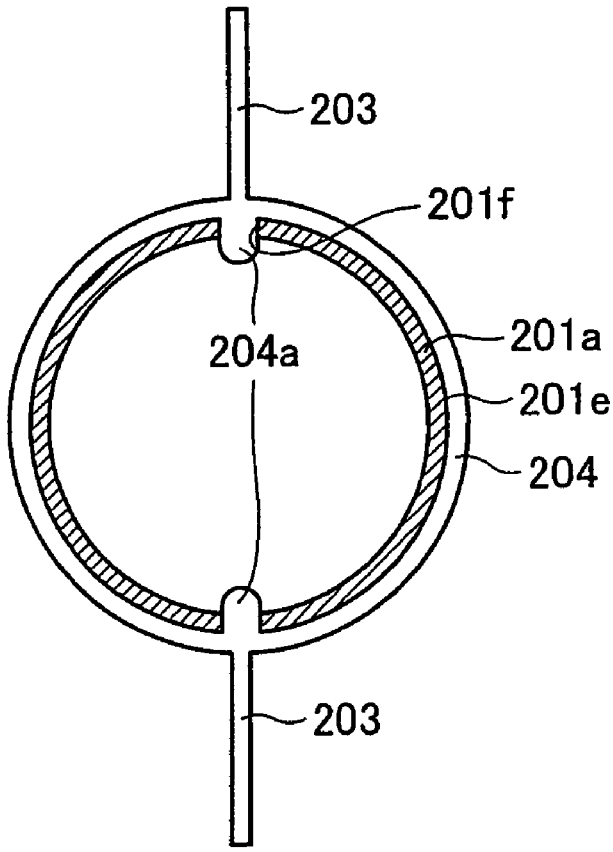
FIG. 6 is a schematic diagram showing the scraper shown in FIG. 5 which is attached to the toner bottle.

Moreover, as shown in FIG. 4, scrapers 203 are provided on a peripheral surface 201*e* of the tip portion 201*a*, and each of the scrapers 203 is in the shape of a plate made of resin having elasticity, such as rubber. The scrapers 203 are provided on the surface of a ring-shaped fixation member 204 made of a material having retractility (resins, etc. having elasticity, such as rubber). The fixation member 204 is formed so as to have an internal diameter which is slightly smaller than an external diameter of the tip portion 201*a*. Moreover, as shown in FIG. 5, a protruding portion 204*a* is formed on an inner peripheral surface of the fixation member 204. As shown in FIG. 6, the protruding portion 204*a* fits a cutout portion 201*f* which is formed on the tip portion 201*a* in advance.

Only by attaching the fixation member 204 to the peripheral surface 201*e* of the tip portion 201*a* by slightly stretching a ring portion of the fixation member 204, the scraper 203 can be easily provided on the main body portion 201. In addition, when attaching the fixation member 204 to the tip portion 201*a*, the protruding portion 204*a* of the fixation member 204 fits the cutout portion 201*f* formed on the peripheral surface 201*e* of the tip portion 201*a*. Thus, the fixation member 204 can be surely fixed to the tip portion 201*a*. That is, the fixation member 204 does not slip on the peripheral surface 201*e* of the tip portion 201*a*, and can be driven integrally with the tip portion 201*a*.

Note that the scraper 203 may be provided directly on the peripheral surface 201*e* of the tip portion 201*a*.

Figure 7:
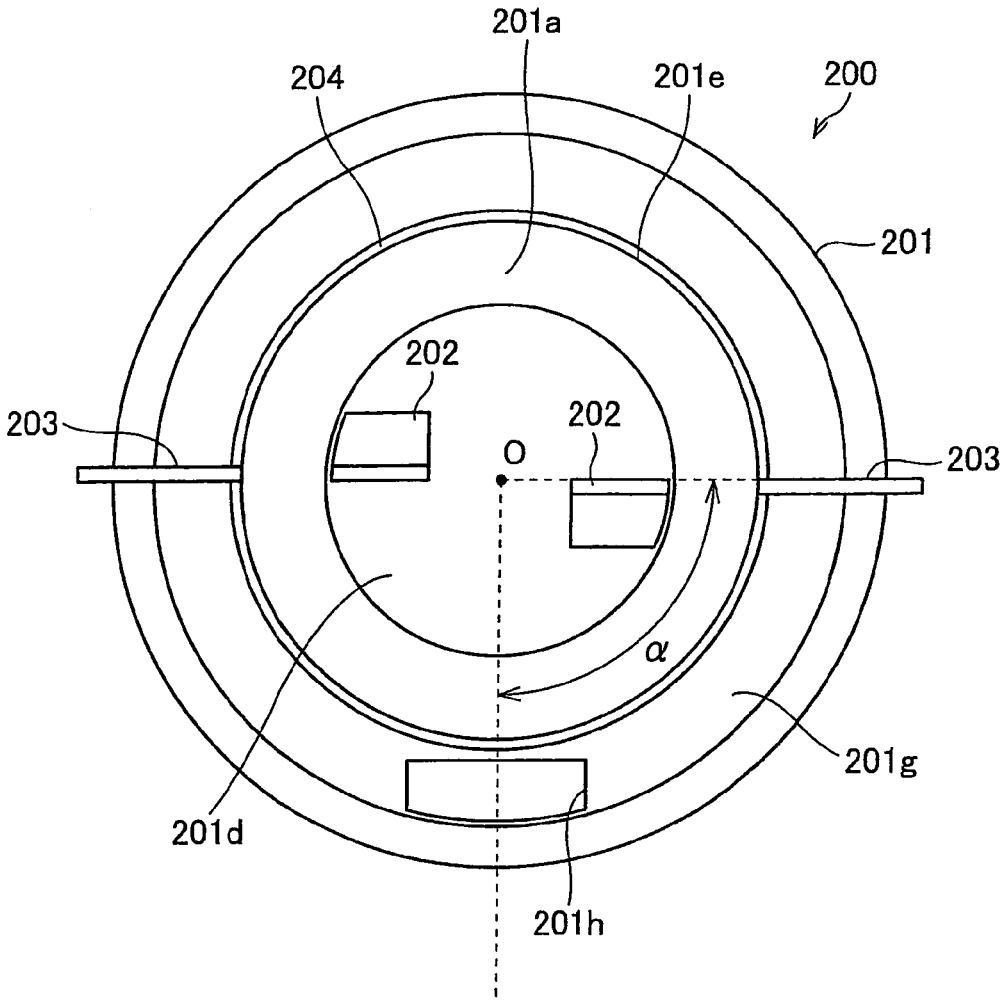
FIG. 7 is a front view of the toner bottle constituting the developer supplying apparatus shown in FIG. 1.

As shown in FIG. 7, the above-described two scrapers 203 are formed so as to be located on substantially a straight line, which passes through a center O of the tip portion 201*a*, when the fixation member 204 is attached to the tip portion 201*a*.

Moreover, as shown in FIG. 7, a bottle-side toner discharging opening 201*h* for discharging the toner stored in the main body portion 201 is formed on an end surface 201*g* whose level in height is different from that of the tip portion 201*a* so that a step is formed therebetween. FIG. 7 shows the bottle-side toner discharging opening 201*h* which is in the shape of substantially a rectangle, however the shape of the bottle-side toner discharging opening 201*h* is not limited to this. The bottle-side toner discharging opening 201*h* may be in the shape of substantially a square, a polygon, a circular, etc. as long as the toner is discharged without any problem.

When attaching the fixation member 204, the scrapers 203 are adjusted so as to be located at a position which is at a predetermined angle $\alpha$ with respect to a center of the bottle-side toner discharging opening 201*h*. Here, the positions of the scrapers 203 are preferably such a position that the discharging of the toner from the bottle-side toner discharging opening 201*h* is not disturbed. The angle $\alpha$ may be any angle as long as the scrapers 203 are located at such the position. However, it is preferable that the angle $\alpha$ be 90° so that it is possible to surely prevent troubles regarding the discharging of the toner from the bottle-side toner discharging opening 201*h*.

The toner discharged from the bottle-side toner discharging opening 201*h* is stored in the bottle supporting member 300 which is provided so as to cover the tip portion 201*a*. The bottle supporting member 300 has a supporting body-side toner discharging opening (will be described later) for discharging the stored toner.

As shown in FIGS. 1(*a*) and 1(*b*), the bottle supporting member 300 is in the shape of substantially a cylinder, and includes a first case 301 and a second case 302 which are attached to each other so as to cover the tip portion 201*a* of the main body portion 201. Note that a first opening portion 300*a* is formed so that at least the ribs 202 provided on the tip surface 201*d* of the tip portion 201*a* are exposed.

Formed on the surface of the first case 301 are a first fixation member 303 and a second fixation member 304 which are formed in parallel with each other. Each of the first fixation member 303 and the second fixation member 304 is in the shape of a plate, and is formed for fixing the developer supplying apparatus 100 attached to the printer (A) shown in FIG. 2. As shown in FIG. 1(*b*), the shutter mechanism 400 which carries out a control of discharging, to outside, the toner supplied from the developer supplying apparatus 100 is provided between the first fixation member 303 and the second fixation member 304. Therefore, the height of the first fixation member 303 and the height of the second fixation member 304 are adjusted to secure clearance between the bottle supporting member 300 and the image forming apparatus (A) so that the shutter mechanism 400 functions.

Figure 8:
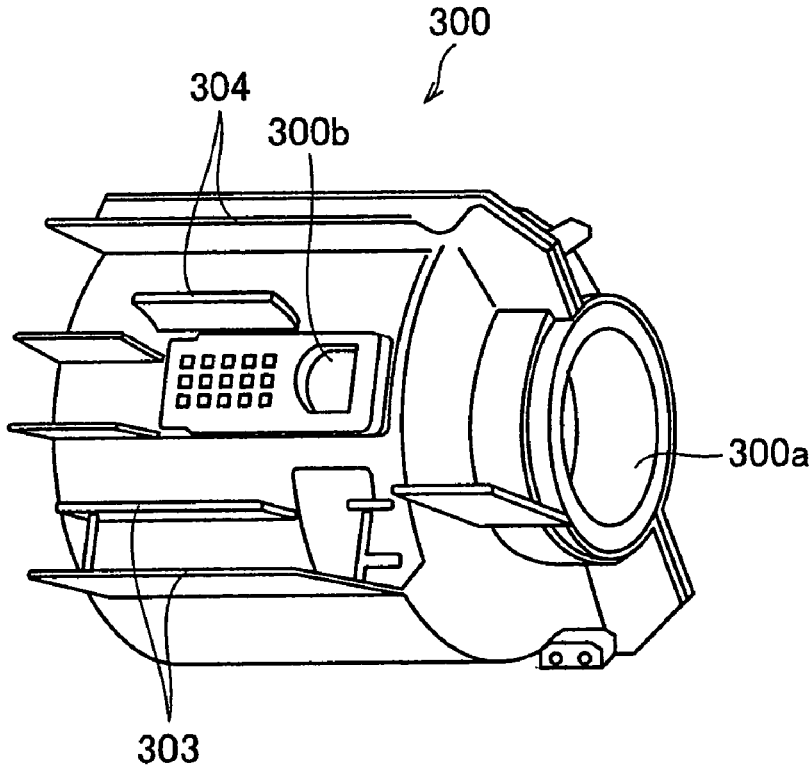
FIG. 8 is a perspective view showing a backside of a bottle supporting member constituting the developer supplying apparatus shown in FIG. 1.

As shown in FIG. 8, the bottle supporting member 300 has a supporting body-side toner discharging opening 300*b* on the bottom surface of the first case 301, that is, between the first fixation member 303 and the second fixation member 304. Note that the shutter mechanism 400 opens and closes the supporting body-side toner discharging opening 300*b*.

Figure 9:
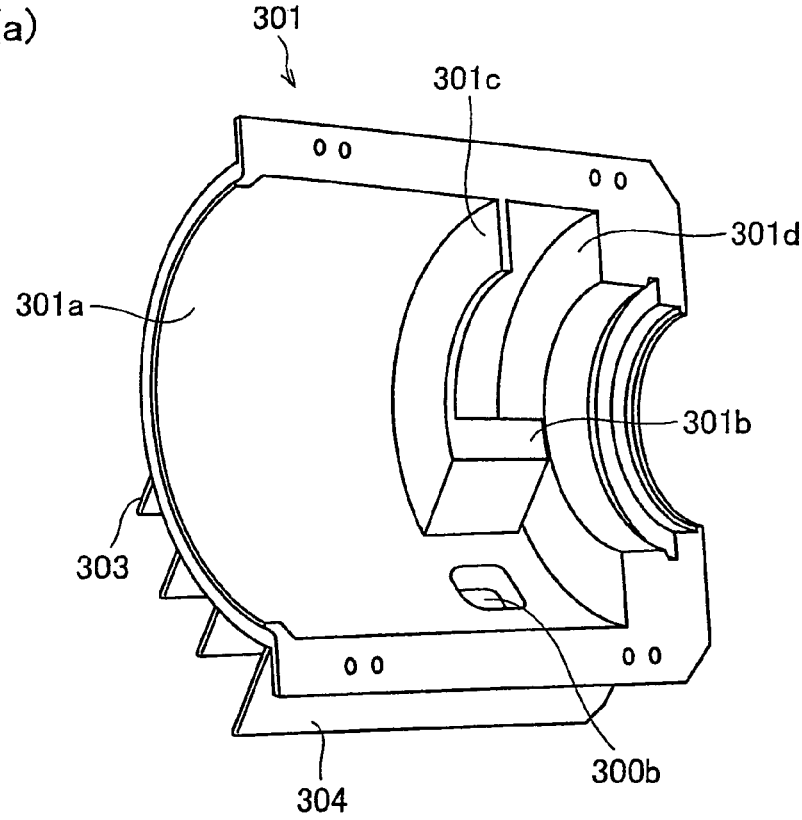
FIG. 9(*a*) shows the bottle supporting member shown in FIG. 8, and is a perspective view of a first case constituting the bottle supporting member.
Figure 9:
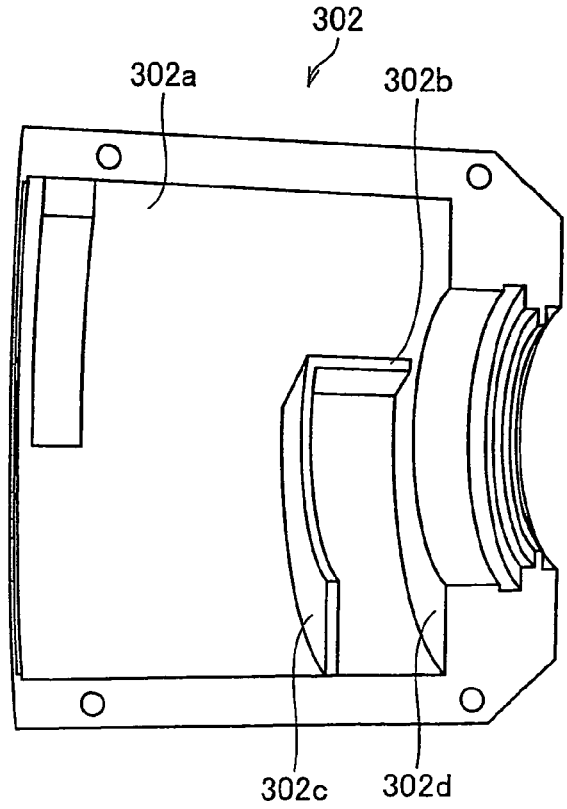

As shown in FIG. 9(*a*), a first weir portion 301*b* for damming up the toner is formed on an inner peripheral surface 301*a* of the first case 301 and near the toner discharging opening 300*b*, and a wall portion 301*c* extends from the first weir portion 301*b* in a direction opposite a direction of the supporting body-side toner discharging opening 300*b*. The wall portion 301*c* is provided so that there is a predetermined interval between the wall portion 301*c* and a contacting surface 301*d* that is one inner end surface of the first case 301. This interval is set so as to be slightly wider than the width of the scraper 203.

As shown in FIG. 9(*b*), a second weir portion 302*b* for damping up the toner is formed on an inner peripheral surface 302*a* of the second case 302, as with the first case 301 shown in FIG. 9(*a*), and a wall portion 302*c* extends from the second weir portion 302*b*. The wall portion 302*c* is provided so that there is a predetermined interval between the wall portion 302*c* and a contacting surface 302*d* that is one inner end surface of the second case 302. This interval is set so as to be slightly wider than the width of the scraper 203.

The bottle supporting member 300 shown in FIG. 8 is formed by attaching the first case 301 and the second case 302 each other.

Figure 10:
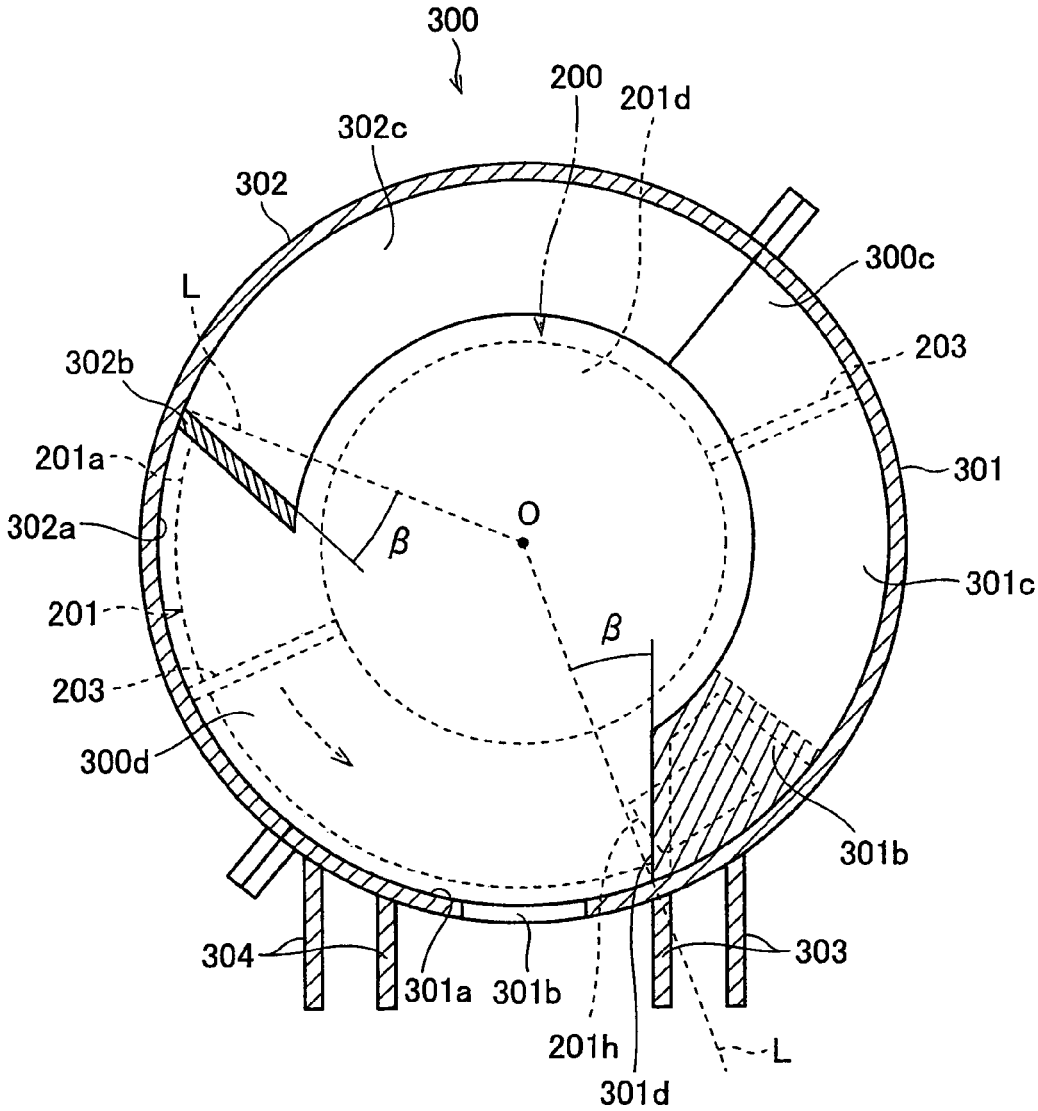
FIG. 10 is a diagram for explaining the relationship between a toner discharging chamber of the bottle supporting member and the position of the scraper of the toner bottle.

Moreover, as shown in FIG. 10, by attaching the first case 301 and the second case 302 each other, a first space is formed by the first weir portion 301*b* of the first case 301, the second weir portion 302*b* of the second case 302, the wall portion 301*c*, and the wall portion 302*c*. Here, in the present embodiment, the first space is termed a toner discharge regulating chamber 300*c* for regulating the discharging of the toner. Meanwhile, in addition to the first space, another space (second space) between the first weir portion 301*b* and the second weir portion 302*b* is termed a toner discharging chamber (temporary storage chamber) 300*d* for temporarily storing the toner from the toner bottle 200 and discharging it.

The toner discharge regulating chamber 300*c* is not a space for practically discharging the toner but a space through which the scraper 203 having gone over the first weir portion 301*b* can pass. Note that the toner discharge regulating chamber 300*c* stores some amount of toner having gone over the first weir portion 301*b* together with the scraper 203, but the toner is scooped out from the second weir portion 302*b* by the rotational transfer of the scraper 203.

Meanwhile, the toner discharging chamber 300*d* functions as a space for temporarily storing the toner discharged from the bottle-side toner discharging opening 201*h* of the toner bottle 200.

Here, as shown in FIG. 10, the contacting surface 301*d* which contacts the scraper 203 is inclined toward a rotation direction (direction indicated by an arrow in FIG. 10) so that the scraper 203 can go over the first weir portion 301*b*. That is, the contacting surface 301*d* is inclined toward the rotation direction of the scraper 203 from a normal line L extending from the rotation center O of the toner bottle 200.

In other words, the first weir portion 301*b* is provided upstream of the bottle-side toner discharging opening 201*h* in a direction in which the toner is conveyed by the scraper 203, and the contacting surface 301*d*, which contacts the scraper 203, of the first weir portion 301*b* is inclined at a predetermined angle β from the normal line L extending from the rotation center O, and divides off the toner discharging chamber 300*d*. The angle β is set appropriately depending on a material, length, etc. of the scraper 203.

Moreover, the first weir portion 301*b* is provided at a position slightly separated from the toner discharging opening 300*b* in the rotation direction of the scraper 203. This is to easily pool the toner in the toner discharging chamber 300*d*. Thus, by easily pooling the toner in the toner discharging chamber 300*d*, it is possible to maintain a constant supply amount of toner discharged from the toner discharging opening 300*b*. Thus, it is possible to supply the toner stably.

Further, the length of the scraper 203 in a longitudinal direction is set to be slightly longer than a distance between the rotation center O of the toner bottle 200 and the inner peripheral surface of the bottle supporting member 300, that is, the radius. This is to effectively scoop out the toner stored in the toner discharging chamber 300*d*. However, if the length of the scraper 203 in the longitudinal direction is too long, a frictional force between the scraper 203 and the inner peripheral surface of the bottle supporting member 300 becomes strong, and the load of rotation increases. Therefore, it is preferable that the length be such that the load of rotation does not increase so much.

Specifically, in the case where the internal diameter of the bottle supporting member 300 is 82 mm and the external diameter of the fixation member 204 is 44 mm, the length of the scraper 203 is set to 20 mm. Thus, the length of the scraper 203 is 1 mm longer than the distance between the inner peripheral surface 301*a* of the bottle supporting member 300 and the fixation member 204. Due to the difference in distance, the load of rotation of the scraper 203 does not increase, and the scraper 203 can scoop out the toner effectively.

Moreover, as with the first weir portion 301*b*, the contacting surface 302*d* (surface facing the toner discharge regulating chamber 300*c*), which contacts the scraper 203, of the second weir portion 302*b* is inclined at a predetermined angle β from the normal line L extending from the rotation center O, and divides off the toner discharging chamber 300*d*. The angle β is set appropriately depending on the material, length, etc. of the scraper 203.

Note that an interval between the first weir portion 301*b* and the second weir portion 302*b* (width of the toner discharging chamber 300*d*) may be such a distance that the toner discharging opening 300*b* is not closed. However, in order to supply the toner stably, it is necessary to store some amount of toner in the toner discharging chamber 300*d*. Therefore, the interval may be set accordingly depending on a desired amount of toner stored in the toner discharging chamber 300*d*.

Moreover, the scraper 203 is in the shape of a plate, however the shape of the scraper 203 is not limited to this. The scraper 203 may have, for example, a substantially V-shaped cross section. Since the scraper 203 has a substantially V-shaped cross section, the scraper 203 has a sealing function of sealing between the inner peripheral surface of the bottle supporting member 300 and the toner bottle 200. Therefore, it is not necessary to provide a sealing member separately.

In the developer supplying apparatus 100 configured as above, since the toner bottle 200 is rotatably supported by the bottle supporting member 300, there is a small gap between the toner bottle 200 and the bottle supporting member 300. On this account, without an appropriate seal between the toner bottle 200 and the bottle supporting member 300, the toner leaks from somewhere other than the toner discharging opening 300*b* of the bottle supporting member 300.

Figure 11:
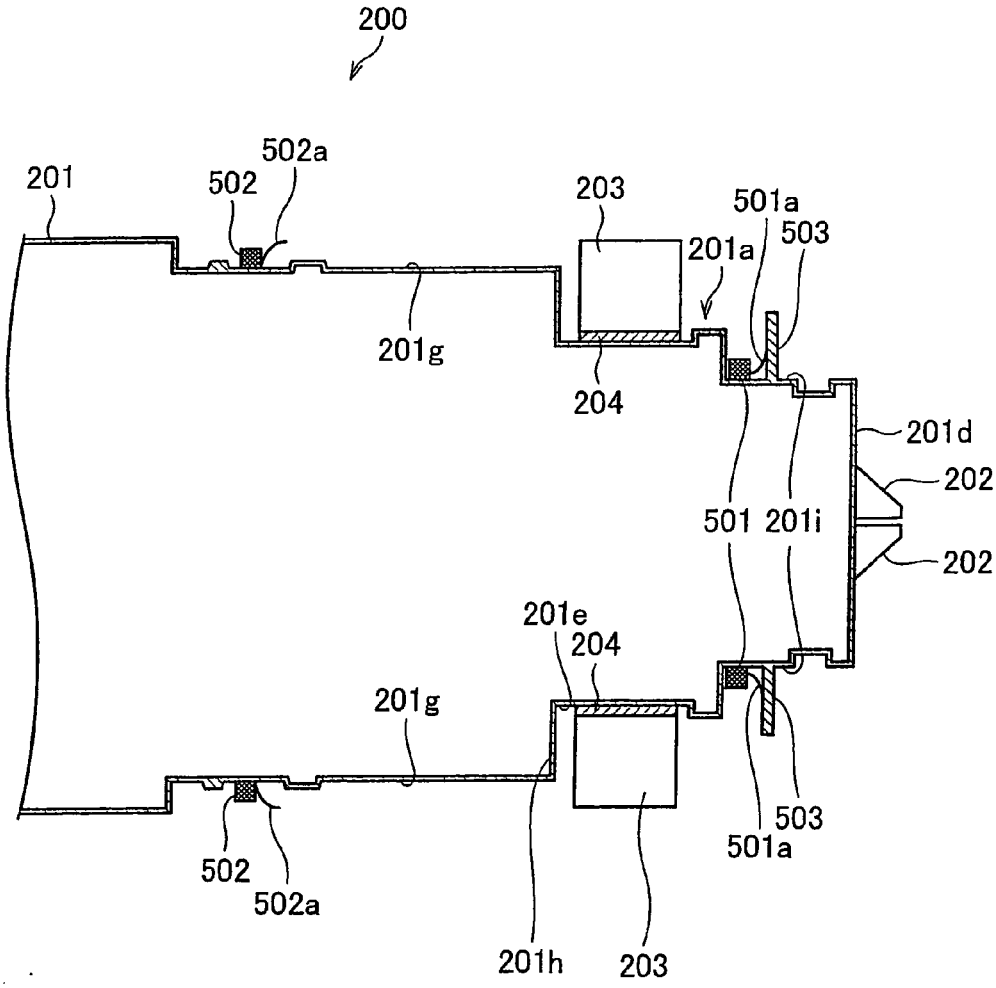
FIG. 11 is a schematic cross-sectional view of the tip portion of the toner bottle.

On this account, in the present embodiment, as shown in FIG. 11, two V rings 501 and 502 which function as seals are attached to the tip portion 201*a* of the main body portion 201 of the toner bottle 200.

The V ring 501 is attached to a peripheral surface 201*i* (of the tip portion 201*a*) located outside a position where the scraper 203 is attached, and the V ring 502 is attached to an end surface 201*g* (of the tip portion 201*a*) located inside the position where the scraper 203 is attached.

A slip ring 503 (a plate-like annular member) is attached further outside a position where the V ring 501 is attached, so as to secure clearance between the toner bottle 200 and the bottle supporting member 300 and to cause the toner bottle 200 to rotate smoothly.

The V rings 501 and 502 are attached to the main body portion 201 by causing a seal strip 501*a* of the V ring 501 to contact the slip ring 503 and a seal strip 502*a* of the V ring 502 to contact an inner peripheral surface (will be described later) of the bottle supporting member 300. Thus, these two V rings 501 and 502 function as the seals.

The slip ring 503 rotatably fits the peripheral surface 201*i* of the tip portion 201*a* of the main body portion 201, and is fixed by the inner peripheral surface of the bottle supporting member 300 when the bottle supporting member 300 is attached to the toner bottle 200.

Thus, the slip ring 503 is fixed to the bottle supporting member 300, and the main body portion 201 of the toner bottle 200 rotates on the inner peripheral surface of the slip ring 503.

Figure 12:
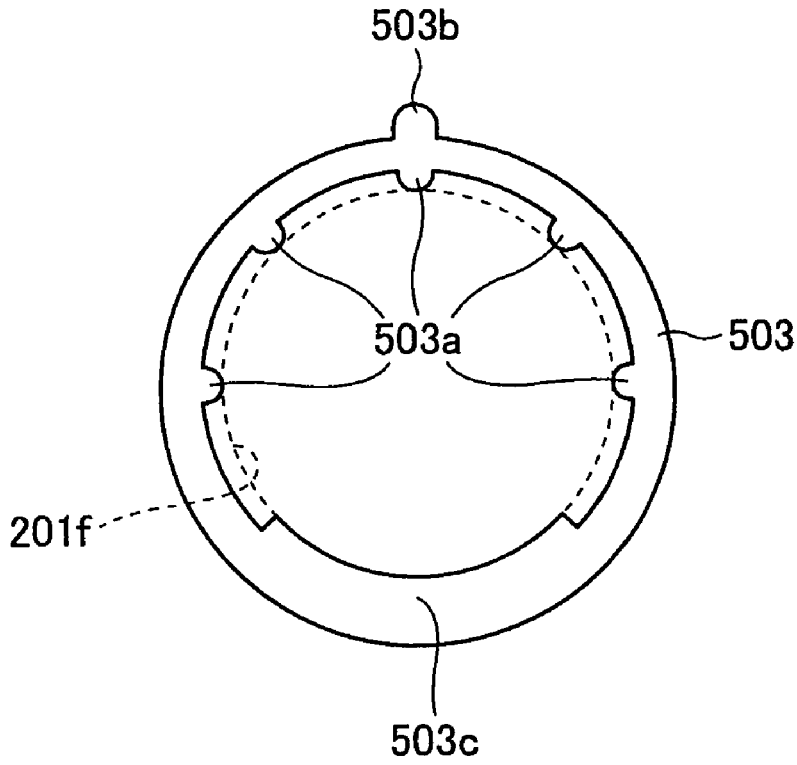
FIG. 12 is a front view of a slip ring attached to the tip portion of the toner bottle shown in FIG. 11.

The following will explain one example of the slip ring 503 in reference to FIG. 12.

As shown in FIG. 12, a plurality of protruding portions 503*a* and a substantially circular arc supporting portion 503*c* are formed on an inner peripheral surface of the slip ring 503. Note that each of the protruding portions 503*a* is in point-contact with the peripheral surface 201*i* that is an attachment surface of the tip portion 201*a* of the main body portion 201, and the supporting portion 503*c* is in line-contact with the peripheral surface 201*i* and has the same curvature as the peripheral surface 201*i*. Moreover, a protruding portion 503*b* is formed on a top of an outer peripheral surface of the slip ring 503. The protruding portion 503*b* fits a cutout (not shown) formed on the inner peripheral surface of the bottle supporting member 300.

Usually, since the slip ring 503 and the main body portion 201 of the toner bottle 200 slide, it is possible to cause the toner bottle 200 to rotate smoothly by reducing the frictional force as much as possible for reducing the load.

Therefore, as shown in FIG. 12, by a plurality of the protruding portions 503*a* which are provided on the inner peripheral surface of the slip ring 503 and in point-contact with the peripheral surface 201*i*, a contact area of the toner bottle 200 and the slip ring 503 becomes small. As a result, it is possible to reduce the frictional force between the slip ring 503 and the main body portion 201 of the toner bottle 200. Thus, it is possible to reduce the rotation load caused by an increase in the frictional force. Therefore, it is possible to cause the toner bottle 200 to rotate smoothly in the slip ring 503.

Note that the shape of the slip ring 503 is not limited to the shape shown in FIG. 12, and may be such a shape (for example, a polygon) that the slip ring 503 point-supports the toner bottle 200.

That is, formed on the inner peripheral surface of the plate-like slip ring 503 are (I) the supporting portion 503*c* which (i) is in the shape of a circular arc whose diameter is obtained by adding predetermined clearance between the inner peripheral surface of the slip ring 503 and the peripheral surface 201*i* of the toner bottle 200 to the supporting portion 503*c*, and (ii) is located at a lower position at a predetermined angle, and (II) the projecting portions 503*a* which are formed on a part of a portion other than the supporting portion 503*c*, the portion having a further larger curvature. In other wards, the slip ring 503 includes (i) the supporting portion 503*c* which is provided on a part of the inner surface thereof and projects inwardly, and (ii) the projecting portions 503*a* which are provided at predetermined intervals on the other part of the inner surface thereof and project inwardly, and moreover, the height of the supporting portion 503*c* projecting inwardly is substantially the same as the height of the projecting portion 503*a* projecting inwardly.

Thus, it is possible to prevent wear of the toner bottle 200 by supporting the weight of the toner bottle 200 with the circular arc supporting portion 503*c*, and also possible to reduce the load of slide by substantially point-supporting the toner bottle 200 with the projections provided at predetermined intervals or with the polygon shape.

In addition, since the seal strip 501*a* of the V ring 501 contacts the slip ring 503, it is possible to surely prevent the toner from leaking downward (direction of gravitational force) from the bottle supporting member 300.

Figure 13:
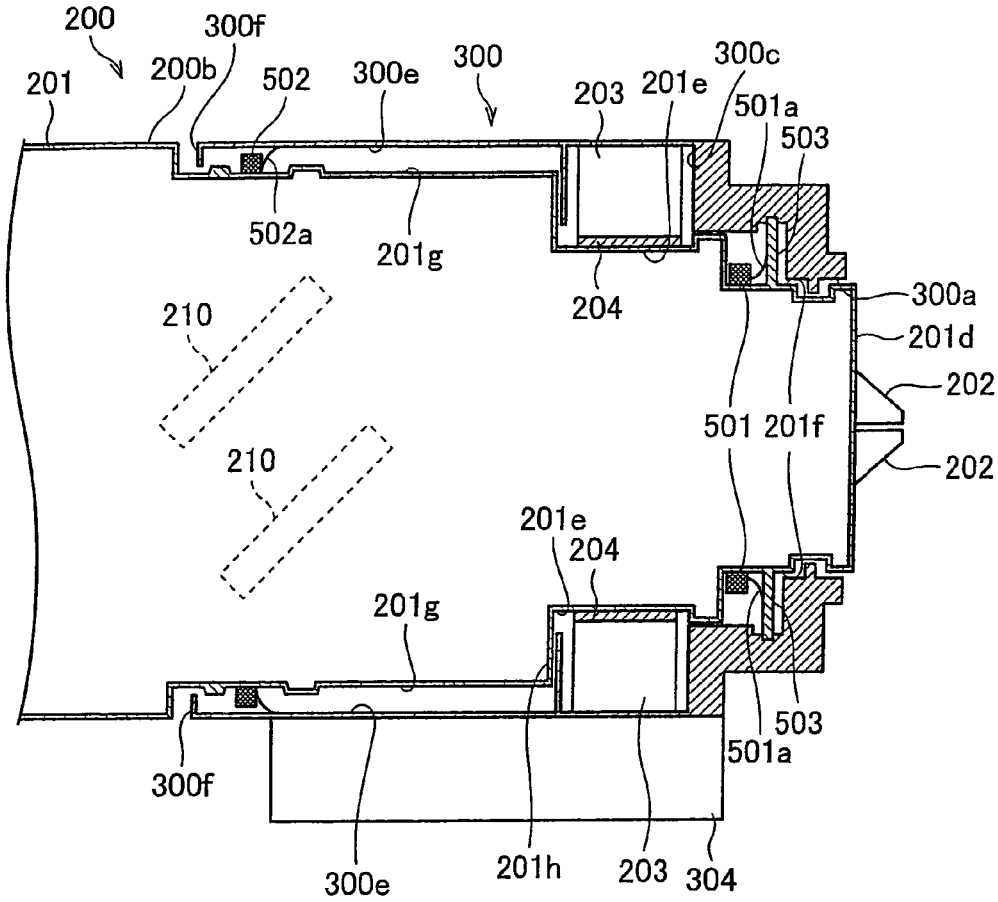
FIG. 13 is a schematic cross-sectional view of the bottle supporting member attached to the tip portion of the toner bottle shown in FIG. 11.

As shown in FIG. 13, when the tip portion 201*a* of the main body portion 201 of the toner bottle 200 is supported by the bottle supporting member 300, the V ring 502 is attached to the tip portion 201*a* so that the seal strip 502*a* contacts an inner peripheral surface 300*e* of the bottle supporting member 300. Thus, it is possible to prevent the toner from leaking from a rear portion 300*f* of the bottle supporting member 300.

Note that an attachment portion of the first case 301 and the second case 302 is sealed adequately.

As above, regarding the bottle supporting member 300, all of the portions where the leakage of the toner may occur are sealed.

Moreover, as shown in FIG. 13, plate-like ribs 210 are provided on the peripheral surface of the tip portion 201*a* of the main body portion 201 of the toner bottle 200. Note that the plate-like ribs 210 are provided in an oblique direction, in parallel with each other, and made of resin, etc. having elasticity. When the bottle supporting member 300 supports the toner bottle 200, the ribs 210 contacts an inner peripheral surface e of the bottle supporting member 300.

Thus, by the rotation of the ribs 210, it is possible to discharge the toner having gotten into the gap between the toner bottle 200 and the bottle supporting member 300.

The bottle supporting member 300 configured as above is configured by attaching two cases that are the first case 301 and the second case 302 each other. By detachably attaching the first ease 301 and the second case 302 each other, it is possible to easily replace seal members (the V rings 501 and 502, the slip ring 503, and the rib 203 that are expendable supplies) by detaching the first case 301 and the second case 302 when doing maintenance of the developer supplying apparatus 100. That is, it is possible to improve maintenance of the developer supplying apparatus 100.

Generally, the size of the bottle supporting member 300 and the size of the toner bottle 200 need to be designed accurately so that the leakage of the toner does not occur from a portion, supported by the bottle supporting member 300, of the toner bottle 200.

However, since the toner bottle 200 is generally formed by blow molding, its size easily varies. Similarly, since the bottle supporting member 300 is formed by the blow molding, its size easily varies.

As described above, the V ring 502 causes the seal strip 502*a* to contact the inner peripheral surface 300*e* of the bottle supporting member 300, so that the seal strip 502*a* functions as a seal. Therefore, a molding error of the bottle supporting member 300 and/or a molding error of the toner bottle 200 can be canceled by the gap between the toner bottle 200 and the bottle supporting member 300, that is, by a space between the surface of the main body portion 201 of the toner bottle 200 and the bottle supporting member 300.

The following will explain the shutter mechanism 400.

Figure 14:
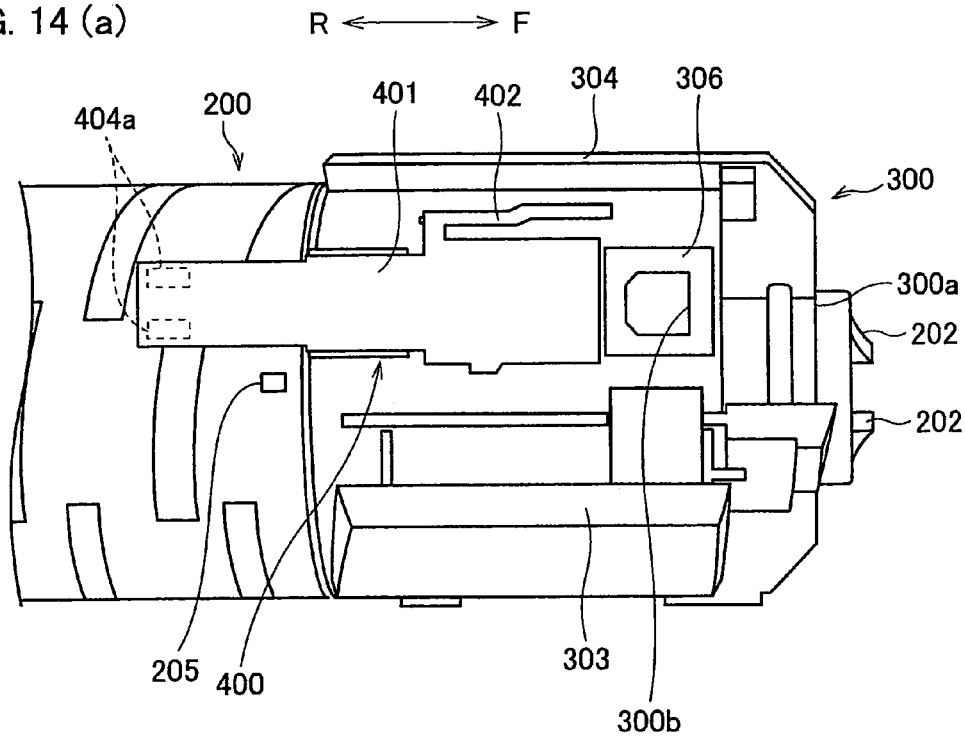
FIG. 14(*a*) is a back view of the bottle supporting member of the developer supplying apparatus, and is a diagram showing a toner discharging opening that is open.
Figure 14:
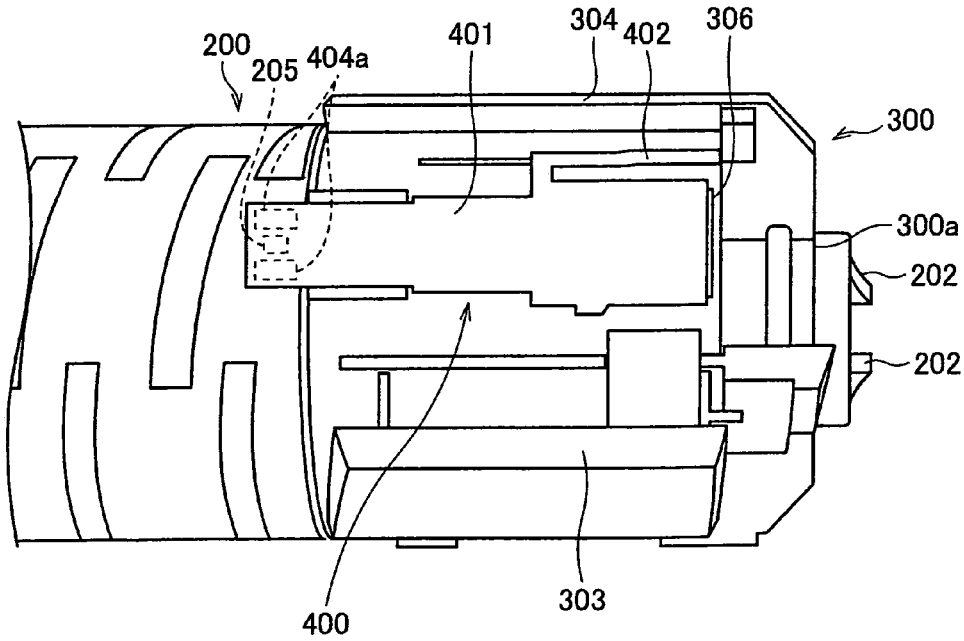

As shown in FIGS. 14(*a*) and 14(*b*), the shutter mechanism 400 includes a plate-like shutter member 401 on the bottom surface of the bottle supporting member 300, and the shutter member 401 can slide in an arrow F direction and an arrow R direction. Here, in FIGS. 14(*a*) and 14(*b*), a side where the opening portion 300*a* of the tip portion of the bottle supporting member 300 or the ribs 202 of the toner bottle 200 project is referred to as a front (F) side, and a side opposite the front side is referred to as a rear (R) side.

FIG. 14(*a*) is a diagram showing that the shutter member 401 of the shutter mechanism 400 slides in the arrow R direction so that the toner discharging opening 300*b* of the bottle supporting member 300 is open.

FIG. 14(*b*) is a diagram showing that the shutter member 401 of the shutter mechanism 400 slides in the arrow F direction so that the toner discharging opening 300*b* of the bottle supporting member 300 is closed.

Figure 15:
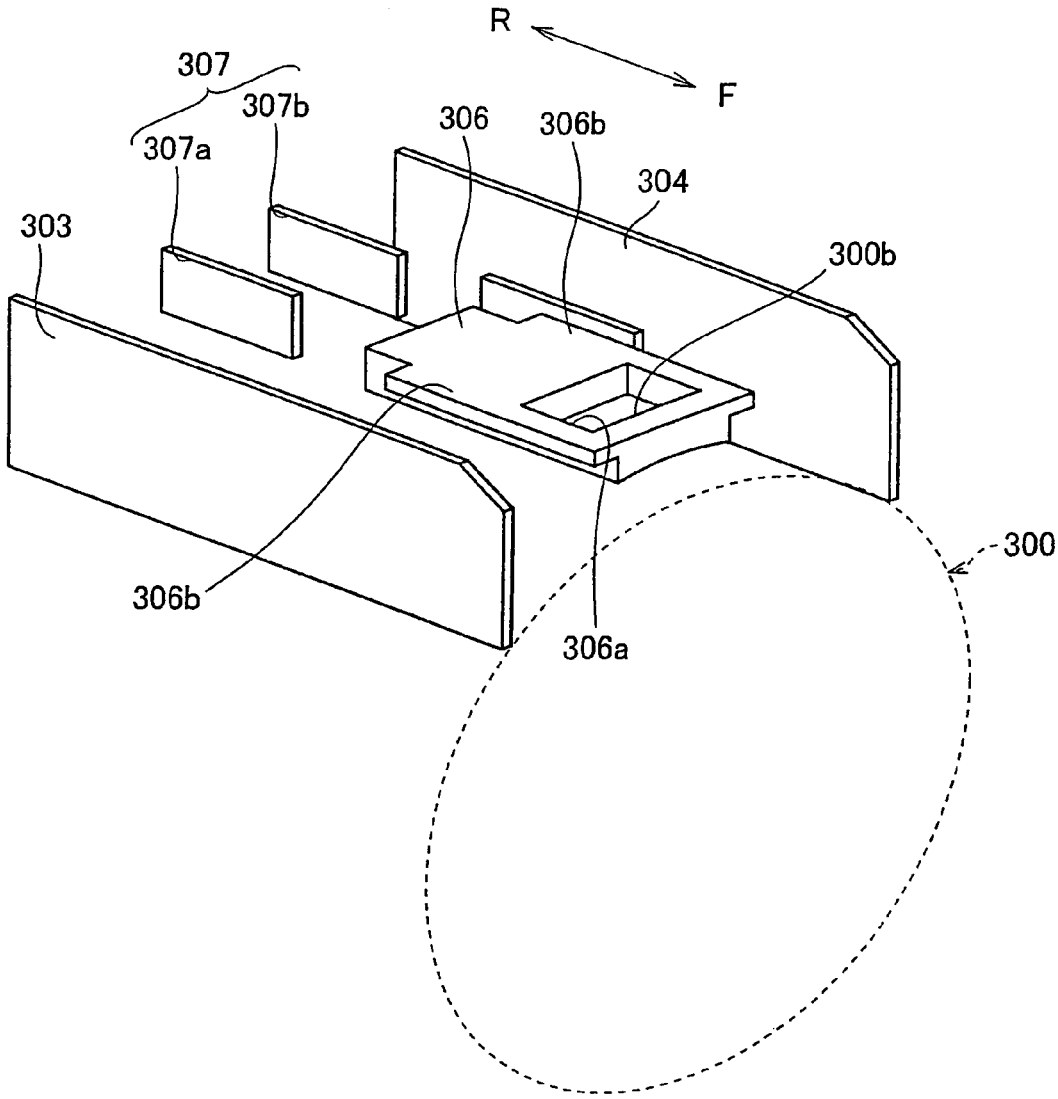
FIG. 15 is a diagram showing a schematic configuration of a backside of the bottle supporting member of the developer supplying apparatus.

As shown in FIG. 15, the bottle supporting member 300 includes a first guide member 306 and a second guide member 307 for guiding the shutter member 401.

The first guide member 306 is a substantially flat plate-like member which is substantially in parallel with the bottom surface of the bottle supporting member 300, and has an opening portion 306*a* which is in communication with the toner discharging opening 300*b* of the bottle supporting member 300. Further, side portions 306*b* of the first guide member 306 are thin, are formed on a side of one surface opposite another surface contacting the bottle supporting member 300, and are lined up in a direction perpendicular to the arrow F/R direction. These side portions 306*b* function as guide rails for the shutter member 401.

Moreover, the second guide member 307 is provided downstream of the first guide member 306 in the arrow R direction, extends in the arrow R direction, and includes two guide plates 307*a* and 307*b* whose plate surfaces face each other. These guide plates 307*a* and 307*b* function as guide rails for the shutter member 401.

Figure 16:
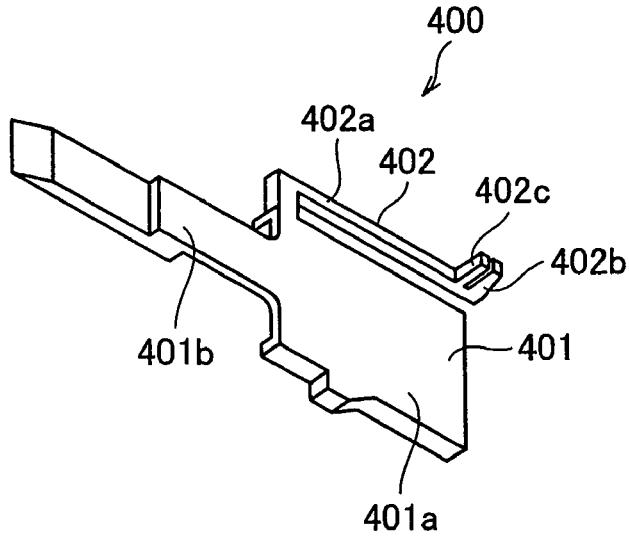
FIG. 16(*a*) is a perspective view of a front side of a shutter mechanism.
Figure 16:
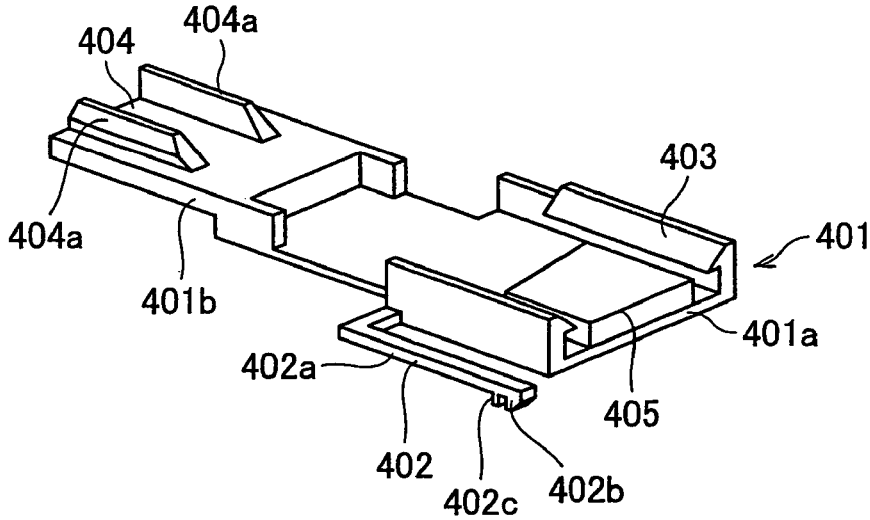

The following will explain the shutter member 401 in reference to FIGS. 16(*a*) and 16(*b*).

FIG. 16(*a*) is a perspective view of a front side of the shutter member 401, and FIG. 16(*b*) is a perspective view of a backside of the shutter member 401.

The shutter member 401 is made of plate-like resin, and includes a shutter portion 401*a* which practically covers the opening portion and a guide portion 401*b* which extends from the shutter portion 401*a*.

As shown in FIG. 16(*a*), a regulating member 402 for regulating movement of the shutter member 401 is formed on the shutter portion 401*a*. The regulating member 402 includes (i) a main body portion 402*a*, one end of which is connected to the shutter portion 401*a* and which is in the shape of substantially an "L", and (ii) a first hook portion 402*b* and a second hook portion 402*c* which are formed on another end opposite the end which is connected to the shutter portion 401*a*. The first hook portion 402*b* and the second hook portion 402*c* constitute a claimed claw portion.

There is a predetermined gap between the first hook portion 402*b* and the second hook portion 402*e*. The gap is set to such a distance that a tip portion of the second hook portion 402*c* contacts the first hook portion 402*b* when the second hook portion 402*c* inclines toward the first hook portion 402*b*.

The movement of the regulating member 402 will be described later in detail.

Moreover, as shown in FIG. 16(*b*), provided on a back surface of the shutter portion 401*a* in a longitudinal direction of the shutter member 401 is a first sliding member 403 which supports the first guide member 306, having the toner discharging opening 300*b*, of the bottle supporting member 300 so as to slide on the first guide member 306. That is, as shown in FIG. 17(*a*), the first sliding member 403 supports the first guide member 306 by hook portions 403*a* provided on both sides of the first sliding member 403, so that the first sliding member 403 can slide on the first guide member 306.

Moreover, as shown in FIG. 16(*b*), provided on a back surface of the guide portion 401*b* in the longitudinal direction of the shutter member 401 is a second slide member 404 which supports the guide plates 307*a* and 307*b* of the second guide member 307 so as to slide on the guide plates 307*a* and 307*b*. The second slide member 404 has slide plates 404*a* which are guided by the guide plates 307*a* and 307*b* of the second guide member 307.

Formed on the back surface of the shutter portion 401*a* is a mylar 405 which seals the toner discharging opening 300*b* of the bottle supporting member 300 and is made of sponge. The size of the mylar 405 is not especially limited as long as the mylar 405 can seal the toner discharging opening 300*b* when the shutter portion 401*a* of the shutter member 401 covers the toner discharging opening 300*b*.

Figure 17:
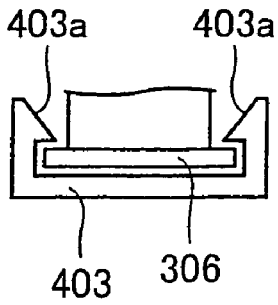
FIG. 17(*a*) is a diagram for explaining the relationship between the shutter mechanism and a first guide member of the bottle supporting member.
Figure 17:
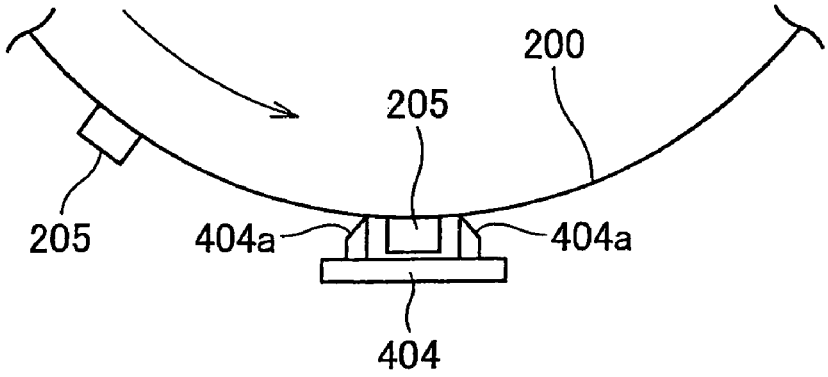

Moreover, as shown in FIG. 17(*b*), when the shutter member 401 moves in the arrow F direction, that is, when the shutter member 401 closes the toner discharging opening 300*a* of the bottle supporting member 300, a hook portion (protruding portion) 205 formed on the surface of the toner bottle 200 enters in a space between the slide plates 404*a* of the second slide member 404, so that the rotation of the toner bottle 200 is regulated by the slide plates 404*a*. Moreover, when the shutter member 401 moves in the arrow R direction, the slide plates 404*a* also moves in the arrow R direction, so that the locking by the slide plates 404*a* and the hook portion 205 is canceled. Thus, the regulation of the rotation of the toner bottle 200 is canceled. That is, the toner discharging opening 300*b* of the bottle supporting member 300 is open, and the rotation of the toner bottle 200 is not hindered when the developer supplying apparatus 100 carries out a toner supplying operation.

The following will explain an attachment of the developer supplying apparatus 100 to the printer, before explaining an open-close operation of the shutter mechanism 400.

Figure 18:
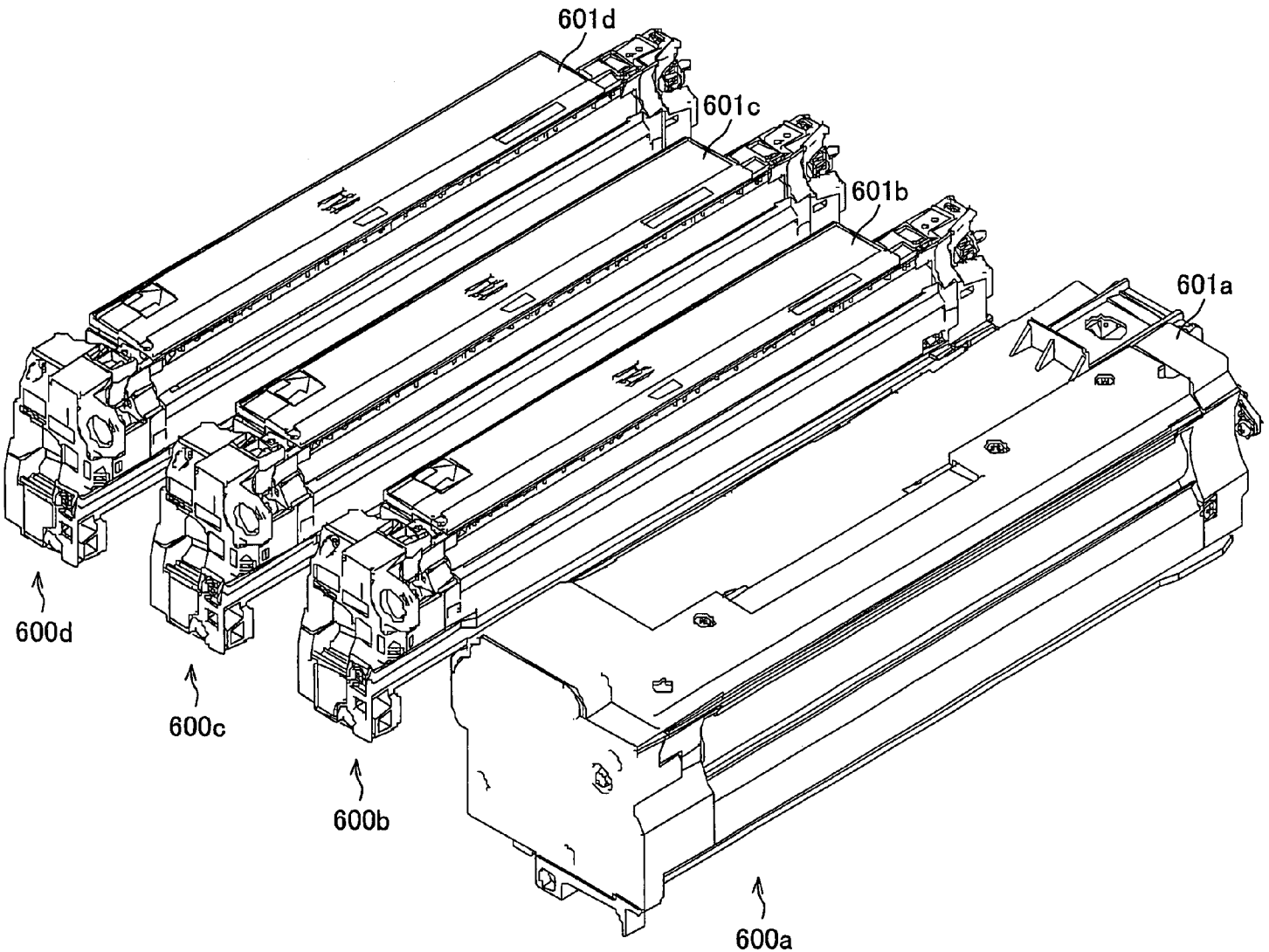
FIG. 18 is a perspective view showing that the developer supplying apparatus is attached to a printer.

For example, as shown in FIG. 18, the developer supplying apparatuses 100 configured as above are attached to attachment mechanisms 600*a* to 600*d* which are provided in the printer for respective colors. Here, two developer supplying apparatuses 100 each containing the black toner can be attached to the attachment mechanism 600*a*.

Figure 19:
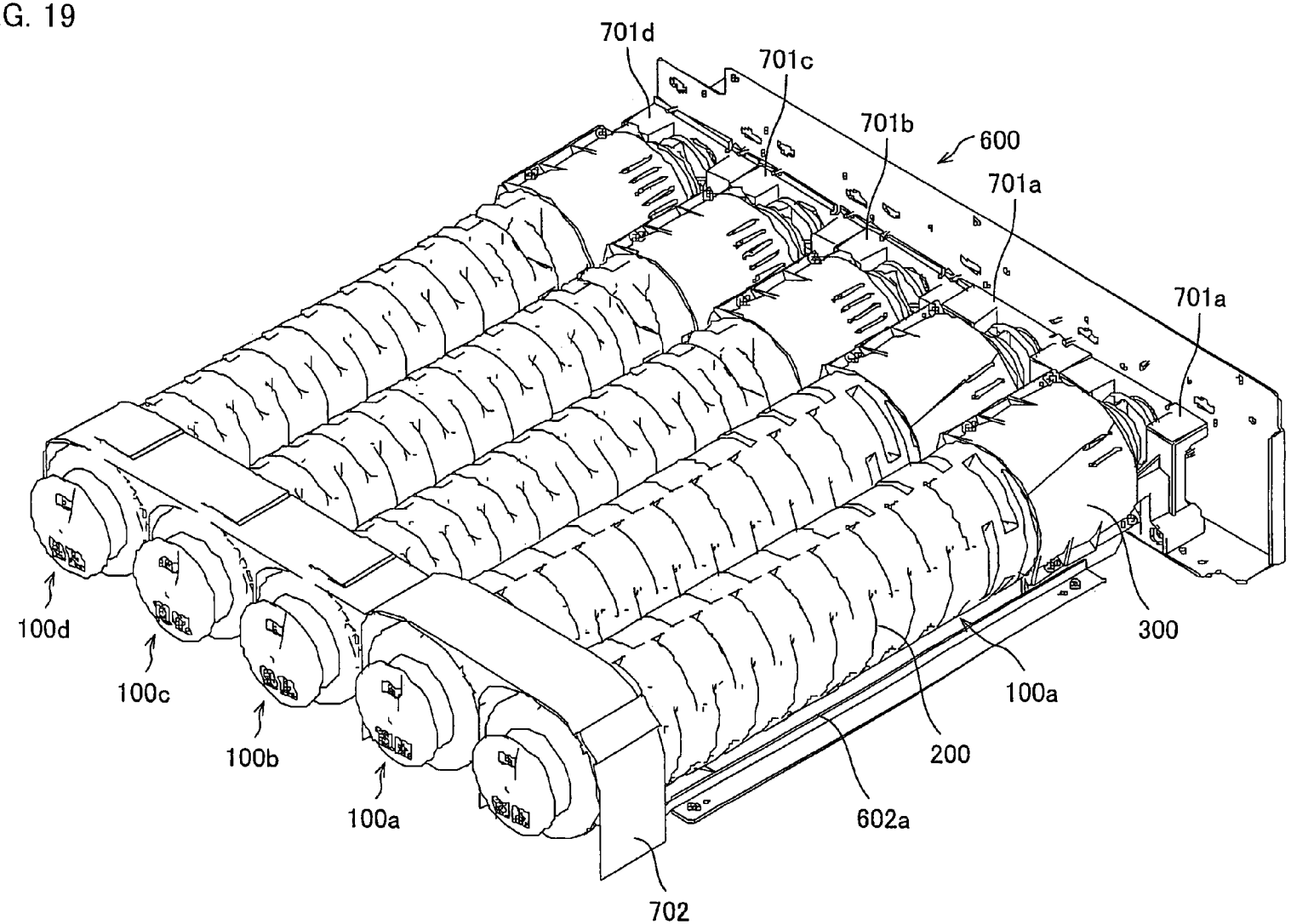
FIG. 19 is a perspective view showing that an upper cover is detached from the state shown in FIG. 18.

The developer supplying apparatus 100 is covered by an upper cover 601 of the attachment mechanism 600. As shown in FIG. 19, the developer supplying apparatus 100 is exposed by detaching the upper cover 601.

As shown in FIG. 19, the bottle supporting member 300 of the developer supplying apparatus 100 is fixed to a driving mechanism 701, and the opposite end of the developer supplying apparatus 100 is fixed by a holding belt 702.

The driving mechanism 701 has the driving portion (not shown) which fits the ribs 202 of the toner bottle 200 projecting from the opening portion 300*a* of the bottle supporting member 300 and transmits the driving force to the ribs 202 in the case where the developer supplying apparatus 100 is attached to the attachment mechanism 600. The driving portion is usually a motor.

Meanwhile, the holding belt 702 holds the toner bottle 200 of the developer supplying apparatus 100 in the case where the developer supplying apparatus 100 is attached to the attachment mechanism 600. The holding belt 702 is detachably attached to the attachment mechanism 600. Moreover, the holding belt 702 is attached to the attachment mechanism 600 so that when the holding belt 702 holds the toner bottle 200, (i) there is a gap between the holding belt 702 and the toner bottle 200 so that the toner bottle 200 can rotate, or (ii) the holding belt 702 contacts the toner bottle 200 so that the frictional force between the holding belt 702 and the toner bottle is such that the toner bottle 200 can rotate.

Figure 20:
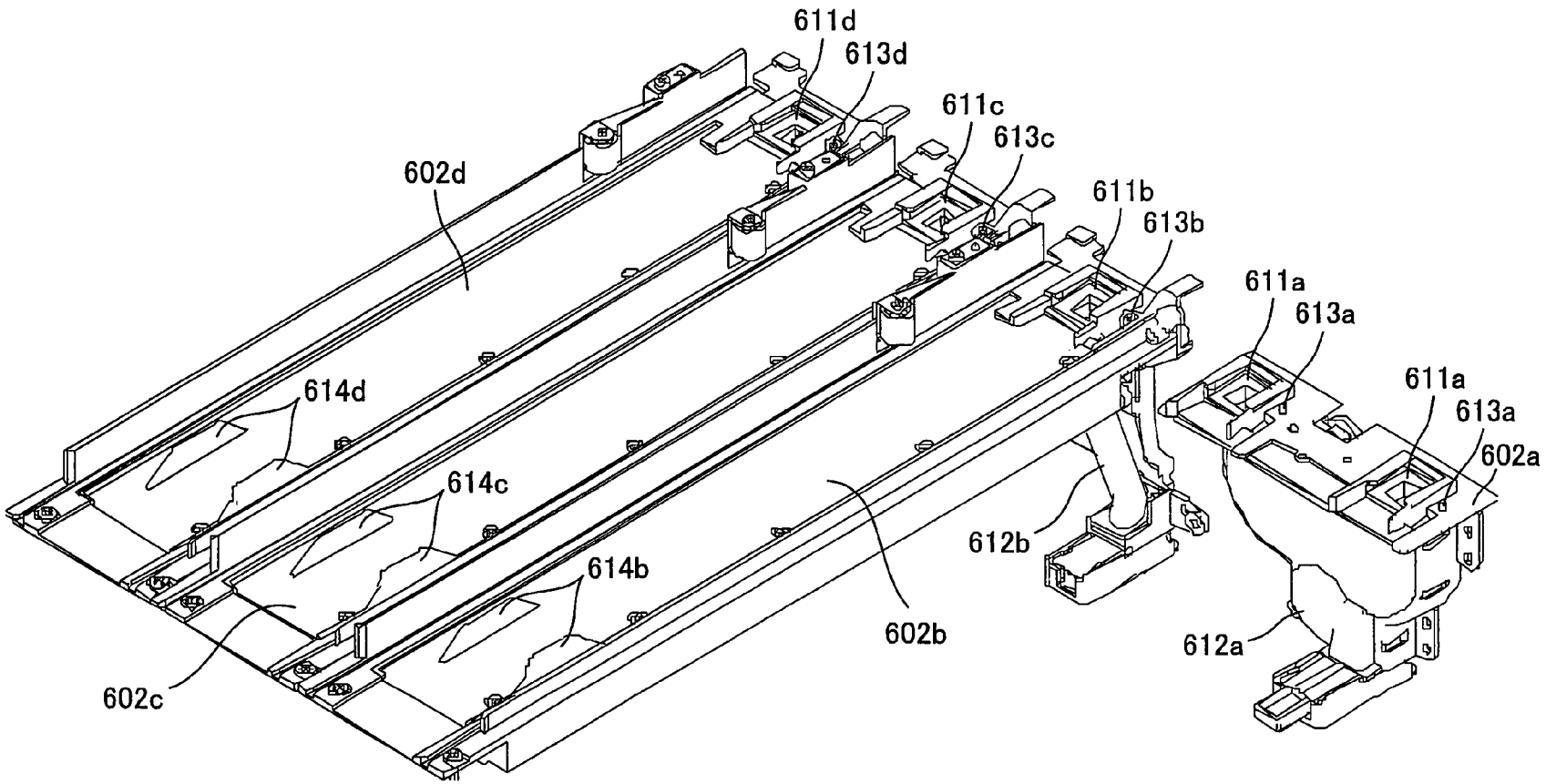
FIG. 20 is a perspective view of an attachment mount, that is, a perspective view showing that the developer supplying apparatus is detached from the state shown in FIG. 18.

As shown in FIG. 20, an opening portion 611 and a toner supply pipe 612 are formed at a portion of the attachment mount 602, to which the developer supplying apparatus 100 is attached, of the attachment mechanism 600, the portion corresponding to the bottle supporting member 300 of the developer supplying apparatus 100. Note that the toner supply pipe 612 is in communication with the opening portion 611 and a developing device (not shown) provided under the attachment mechanism 600. For ease of explanation, FIG. 20 partially omits the attachment mount corresponding to the developer supplying apparatus 100 of the black toner. A pipe 612*a* provided on the attachment mount 602*a* of the developer supplying apparatus 100 for the black toner is formed so as to gather the toners from two opening portions 611*a* corresponding to two developer supplying apparatuses 100 and to supply the toners to one developing device (not shown) for The opening portion 611 of the attachment mount 602 is formed at a position corresponding to the shutter member 401 of the shutter mechanism 400 of the bottle supporting member 300 of the developer supplying apparatus 100. That is, the opening portion 611 is formed at such a position as to be able to accept the toner discharged from the toner discharging opening 300*b* when the shutter mechanism 400 opens the toner discharging opening 300*b* of the bottle supporting member 300.

Moreover, a protruding portion 613 is formed in the vicinity of the opening portion 611. The protruding portion 613 is used in a case where the regulating member 402 of the shutter member 401 of the shutter mechanism 400 regulates the movement of the shutter member 401 by hooking a hook portion (will be described later) of the regulating member 402 to the protruding portion 613. A position of the protruding portion 613 will be described later.

Meanwhile, a supporting member 614 is formed at an end opposite an end where the opening portion 611 of the attachment mount 602 is formed. The supporting member 614 supports a rear portion (one end portion opposite another end portion to which the bottle supporting member 300 is attached) of the toner bottle 200 when the developer supplying apparatus 100 is attached to the attachment mount 602. The supporting member 614 is provided for obtaining predetermined clearance between the toner bottle 200 and the attachment mount 602, and helps the toner bottle 200 to rotate smoothly. The shape, etc. of the supporting member 614 is not especially limited, and the supporting member 614 may have any shape and may be made of any material as long as the shape and material are such that the toner bottle 200 can rotate smoothly.

Here, the bottle supporting member 300 of the developer supplying apparatus 100 is attached to the attachment mechanism 600 by sliding the attachment mount 602 of the attachment mechanism 600. By a sliding operation of the developer supplying apparatus 100, the shutter member 401 of the shutter mechanism 400 of the bottle supporting member 300 opens/closes the toner discharging opening 300*b* of the bottle supporting member 300.

The movement of the shutter member 401 is regulated by the regulating member 402 formed integrally with the shutter member 401.

Figure 21:
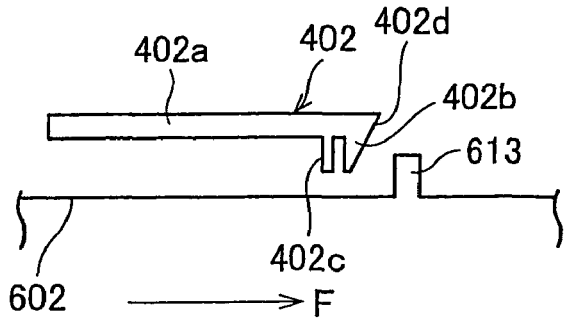
FIG. 21(*a*) is a diagram showing the positional relationship between a regulating member and a protruding portion before the developer supplying apparatus is attached to the attachment mount.
Figure 21:
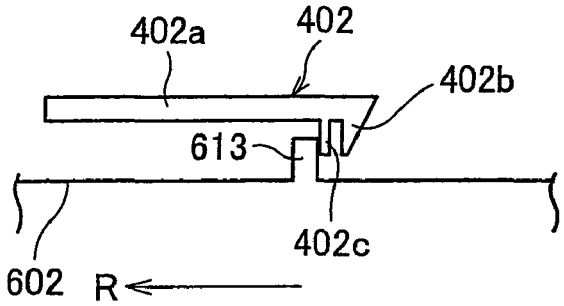
Figure 21:
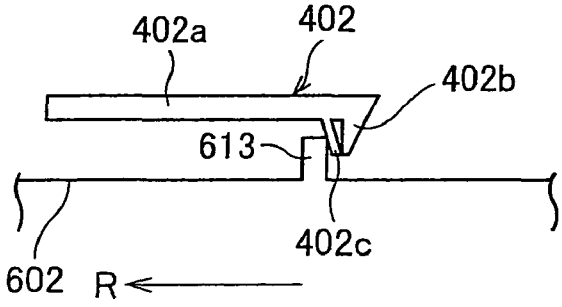

The position of the protruding portion 613 provided in the vicinity of the opening portion 611 is determined depending on a regulating operation of the regulating member 402. Referring to FIGS. 21(*a*) to 21(*c*), the following will explain how the position of the protruding portion 613 is determined.

FIG. 21(*a*) is a diagram showing the positional relationship between the regulating member 402 and the protruding portion 613 before the developer supplying apparatus 100 is attached to the attachment mount 602.

FIG. 21(*b*) is a diagram showing the positional relationship between the regulating member 402 and the protruding portion 613 when the developer supplying apparatus 100 is attached to the attachment mount 602. In this state, the shutter member 401 opens the toner discharging opening 300*b* of the bottle supporting member 300.

FIG. 21(*c*) is a diagram showing the positional relationship between the regulating member 402 and the protruding portion 613 when the developer supplying apparatus 100 is about to be detached from the attachment mount 602.

That is, the protruding portion 613 which engages with the regulating member 402 is formed at such a position that (i) when the developer supplying apparatus 100 is attached to the attachment mount 602, the shutter member 401 opens the toner discharging opening 300*b* of the bottle supporting member 300, and (ii) when the developer supplying apparatus 100 is detached from the attachment mount 602, the shutter member 401 closes the toner discharging opening 300*b* of the bottle supporting member 300.

Here, as described above, the first hook portion 402*b* and the second hook portion 402*c* are formed at the tip portion (an end portion which engages with the protruding portion 613) of the main body portion 402*a* of the regulating member 402.

The first hook portion 402*b* is provided closer to the tip portion than the second hook portion 402*c*, and a contact surface 402*d* is formed so as to be inclined so that the first hook portion 402*b* can easily go over the protruding portion 613. Note that the contact surface 402*d* may be inclined so that a contact area of the contact surface 402*d* and the top of the protruding portion 613 is as small as possible.

Thus, when the contact surface 402*d* of the first hook portion 402*b* is inclined, and the regulating member 402 moves in the arrow F direction from the state shown in FIG. 21(*a*), the first hook portion 402*b* goes over the protruding portion 613 formed on the first case 301, and the second hook portion 402*c* also goes over the protruding portion 613 when the regulating member 402 further moves in the arrow F direction. Therefore, when the regulating member 402 intends to move in a direction opposite the arrow F direction, the movement of the regulating member 402 is regulated by the protruding portion 613 and the second hook portion 402*c* (see FIG. 21(*b*)).

Next, when the shutter mechanism 400 opens the toner discharging opening 300*b* of the bottle supporting member 300, the regulating member 402 moves in the arrow R direction from the position shown in FIG. 21(*b*) along with the movement of the shutter member 401 in the arrow R direction. In this case, as shown in FIG. 21(*c*), the second hook portion 402*c* contacts the protruding portion 613, and then inclines toward the first hook portion 402*b*. When the regulating member 402 further moves in the arrow R direction, the second hook portion 402*c* and the first hook portion 402*b* go over the protruding portion 613. Thus, the toner discharging opening 300*b* of the bottle supporting member 300 opens.

Figure 22:
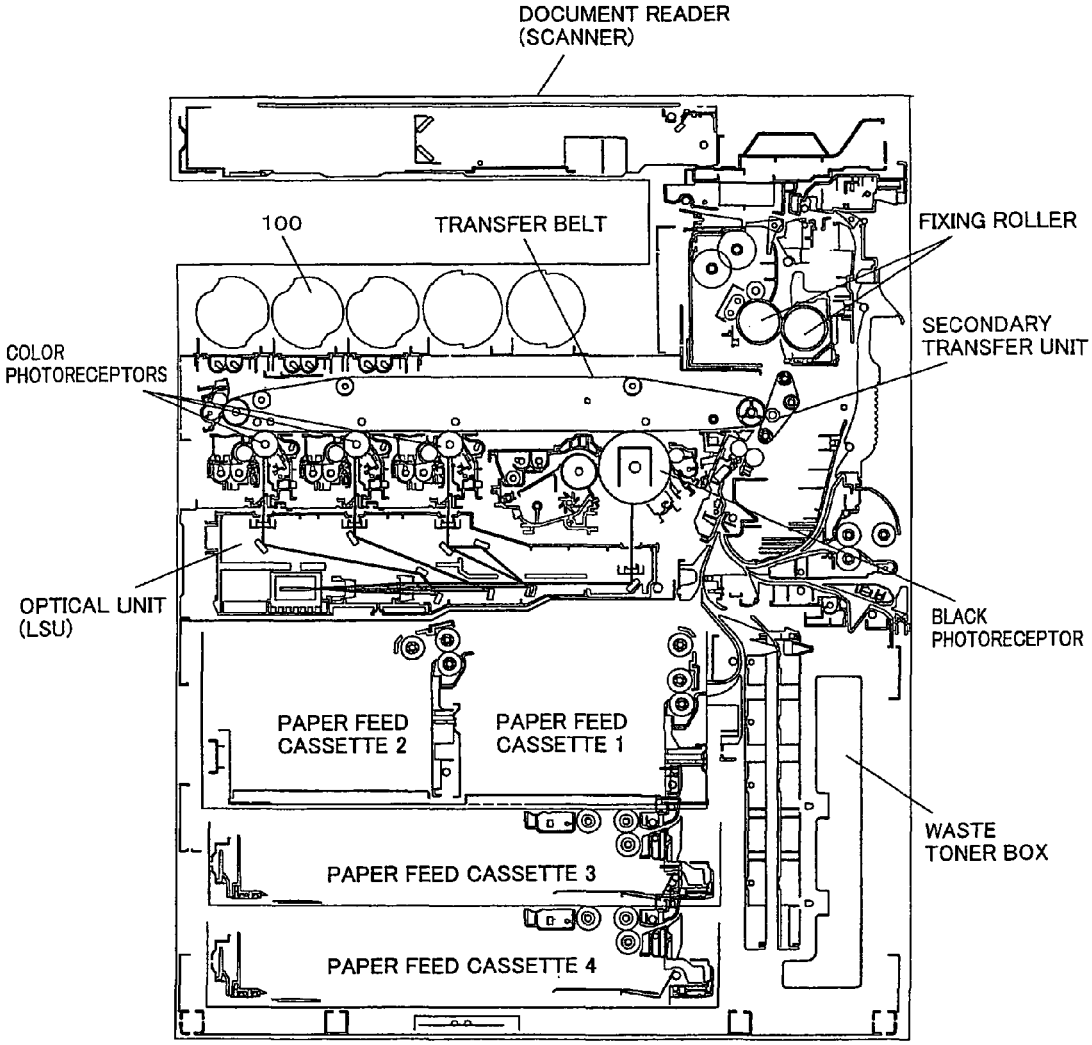
FIG. 22 is a schematic configuration diagram of a copy machine that is another example of the image forming apparatus including the developer supplying apparatus.

The foregoing explained an example of adopting the developer supplying apparatus 100 to the printer shown in FIG. 2, however the present embodiment is not limited to this. For example, the developer supplying apparatus 100 is applicable to a copy machine shown in FIG. 22. Further, the present embodiment is not limited to the printer or the copy machine, and the developer supplying apparatus 100 may be applied to an image forming apparatus which needs the supply of the developer.

Moreover, a developer supplying apparatus may be configured as follows.

The developer supplying apparatus includes (i) a toner bottle which has oblique steps on its circumferential surface and a bottle discharging opening at its end portion (side surface), and (ii) a bottle supporting member which rotatably supports the toner bottle and has a cartridge discharging opening which faces a bottle rotation axis. Inside the bottle supporting member, a toner discharging chamber having the cartridge discharging opening and a toner discharge regulating chamber are divided by partitions formed at a predetermined angle in a circumferential direction, and a radially extending wall of the toner discharge regulating chamber is formed so as to face the bottle discharging opening.

A wiper (having elasticity) fixed to a bottle end portion is located in the toner discharging chamber or in the toner discharge regulating chamber. By the rotation of the bottle, the wiper discharges the toner in the bottle from the bottle discharging opening, and also discharges the toner in the toner discharging chamber or in the toner discharge regulating chamber from the cartridge discharging opening.

Moreover, the wiper may be provided at a predetermined angle (≈90°) with respect to the bottle discharging opening.

Thus, it is possible to prevent a discharge error caused by the toner which is wiped out by the wiper and covers the bottle discharging opening.

Moreover, the wiper may be configured so as to have retractility and include an annular fixation portion and a plate-like wiper portion. The internal diameter of the annular fixation portion may be smaller than the external diameter of the bottle to be fixed, and a projection provided inside the annular fixation portion may fit a cutout provided on the bottle.

Therefore, only by stretching the rubber ring-like fixation portion and attaching it to the bottle, the wiper can be fixed securely.

Further, the wiper may be inclined (skew) in a direction opposite its rotation direction.

Moreover, a developer supplying apparatus is so configured as to be a developer supplying apparatus for supplying a developer to a developing device and as to include (I) a developer container which contains the developer and is in the shape of substantially a cylinder and (II) a container supporting body which supports one end portion of the developer container so that the developer container is able to rotate in a peripheral surface direction, the developer container including (i) a first developer discharging opening for discharging the developer, the first developer discharging opening being formed on the above-described one end portion, supported by the container supporting body, of the developer container and (ii) developer conveying means for conveying the developer toward the first developer discharging opening by rotation of the developer container in the peripheral surface direction, the container supporting body including (i) a temporary storage chamber for temporarily storing the developer discharged from the first developer discharging opening of the developer container and (ii) a second developer discharging opening for discharging the developer toward the developing device, the developer contained in the temporary storage chamber being discharged from the second developer discharging opening by the rotation of the developer container, the container supporting body being in the shape of substantially a cylinder, the temporary storage chamber being formed along an inner peripheral surface of the container supporting body, a slip ring being fixed to the inner peripheral surface so as to be slidable on the above-described one end portion, supported by the container supporting body, of the developer container, a first V ring being attached to the above-described one end portion, supported by the container supporting body, of the developer container, and the slip ring contacting a seal strip of the first V ring.

According to the above-described configuration, the developer contained in the developer container that is in the shape of substantially a cylinder is first conveyed toward the container supporting body by the rotation of the developer container in the peripheral surface direction. Since the first developer discharging opening is formed on the above-described one end portion, supported by the container supporting body, of the developer container, the developer is conveyed toward the first developer discharging opening by the rotation of the developer container in the peripheral surface direction, and is discharged from the first developer discharging opening.

Next, the developer having been discharged from the first developer discharging opening is stored in the temporary storage chamber of the container supporting body. Then, the developer is discharged from the second developer discharging opening of the container supporting body toward the developing device by the rotation of the developer container.

Since the developer is discharged from the above-described one end portion of the developer container, the developer can be discharged from the first developer discharging opening more quickly than a case of gathering the developer, contained in the developer container, at a center portion of the developer container.

In addition, after the developer discharged from the first developer discharging opening is temporarily stored in the temporary storage chamber of the container supporting body, it is supplied to the developing device from the second developer discharging opening. Therefore, it is possible to supply the developer stably.

Further, since (i) the slip ring is fixed to the inner peripheral surface of the container supporting body so as to be slidable on the above-described one end portion, supported by the container supporting body, of the developer container, (ii) the first V ring is attached to the above-described one end portion, supported by the container supporting body, of the developer container, and (iii) the slip ring contacts the seal strip of the first V ring, it is possible to surely prevent the developer from leaking to outside.

Thus, it is possible to surely seal the developer supplying apparatus with a simple mechanism.

The slip ring may rotatably fit the above-described one end portion, supported by the container supporting body, of the developer container, and projections formed on an outer peripheral portion of the slip ring may fit a first annular cutout groove of the container supporting body and a second cutout groove of the container supporting body, respectively.

A part of an inner periphery of the slip ring may be in the shape of a circular arc whose diameter is obtained by adding predetermined clearance to a supporting portion which is located at a lower position at a predetermined angle, and the other part of the inner periphery of the slip ring may have a curvature larger than that of the circular arc and have a projection.

Thus, it is possible to reduce the load of slide of the developer container on the slip ring, and also possible to surely prevent the toner from leaking downward.

It is preferable that (i) a second V ring be attached to the above-described one end portion, supported by the container supporting body, of the developer container, and (ii) a seal strip of the second V ring contact the inner peripheral surface of the container supporting body.

Thus, it is possible to seal the developer container to prevent the toner from leaking toward a central portion of the developer container.

Further, a rib which is inclined toward the first developer discharging opening of the developer container is provided on an outer peripheral surface of the above-described one end portion, supported by the container supporting body, of the developer container. Therefore, it is possible to surely seal the above-described one end portion, supported by the container supporting body, of the developer container.

The container supporting body may be formed by detachably attaching a first case and a second case each other.

Thus, it is possible to easily assemble the developer supplying apparatus, and also possible to do maintenance of the developer supplying apparatus easily.

Further, a developer supplying apparatus is so configured as to be a developer supplying apparatus for supplying a developer to a developing device and as to include (I) a developer container which contains the developer and is in the shape of substantially a cylinder and (II) a container supporting body which supports one end portion of the developer container so that the developer container is able to rotate in a peripheral surface direction, the developer container including (i) a first developer discharging opening for discharging the developer, the first developer discharging opening being formed on the above-described one end portion, supported by the container supporting body, of the developer container and (ii) developer conveying means for conveying the developer toward the first developer discharging opening by rotation of the developer container in the peripheral surface direction, the container supporting body including (i) a temporary storage chamber for temporarily storing the developer discharged from the first developer discharging opening of the developer container and (ii) a second developer discharging opening for discharging the developer toward the developing device, and the developer contained in the temporary storage chamber being discharged from the second developer discharging opening by the rotation of the developer container.

According to the above-described configuration, the developer contained in the developer container that is in the shape of substantially a cylinder is first conveyed toward the container supporting body by the rotation of the developer container in the peripheral surface direction. Since the first developer discharging opening is formed on the above-described one end portion, supported by the container supporting body, of the developer container, the developer is conveyed toward the first developer discharging opening by the rotation of the developer container in the peripheral surface direction, and is discharged from the first developer discharging opening.

Next, the developer having been discharged from the first developer discharging opening is stored in the temporary storage chamber of the container supporting body. Then, the developer is discharged from the second developer discharging opening of the container supporting body toward the developing device by the rotation of the developer container.

Since the developer is discharged from the above-described one end portion of the developer container, the developer can be discharged from the first developer discharging opening more quickly than a case of gathering the developer, contained in the developer container, at a center portion of the developer container.

In addition, after the developer discharged from the first developer discharging opening is temporarily stored in the temporary storage chamber of the container supporting body, it is supplied to the developing device from the second developer discharging opening. Therefore, it is possible to supply the developer stably.

Therefore, it is possible to realize the developer supplying apparatus which can stably supply the developer to the development device at high speed.

Moreover, the container supporting body may be in the shape of substantially a cylinder, the temporary storage chamber may be formed along an inner peripheral surface of the container supporting body, and a slide-contact member which is made of a plate-like elastic body and slide-contacts a peripheral surface of the temporary storage chamber may be provided on the end portion, supported by the container supporting body, of the developer container.

Thus, the developer contained in the temporary storage chamber can be surely discharged from the second developer discharging opening by the slide-contact member. As a result, it is possible to more stably supply the developer at higher speed.

The temporary storage chamber may include (1) a developer discharging chamber having the second developer discharging opening and (ii) a developer discharge regulating chamber which is located close to the developer discharging chamber and regulates the amount of developer discharged from the second developer discharging opening.

Moreover, (i) the slide-contact member may be formed on an annular fixation member having retractility, (ii) the fixation member may be set to have an internal diameter which is smaller than an external diameter of a slide-contact member attaching position of the developer container, (iii) a protruding portion(s) protruding in a radial direction may be formed on the inner peripheral surface of the fixation member, and (iv) a cutout portion(s) which fits the protruding portion(s) formed on the fixation member may be formed on the slide-contact member attaching position of the developer container.

Thus, it is possible to surely fix the slide-contact member to the developer container.

A wall(s) may be provided for dividing the developer discharging chamber from the developer discharge regulating chamber, the wall may be provided upstream of the second developer discharging opening in a direction in which the developer is conveyed by rotation of the slide-contact member, and a contacting surface, contacting the slide-contact member, of the wall may be formed so as to be inclined at a predetermined angle with respect to a normal line extending from a rotation center of the developer container.

It is preferable that the slide-contact member be attached to such a position as not to cover the first developer discharging opening.

The slide-contact member may be formed so that its cross section orthogonal to a slide-contact direction is in the shape of substantially a "V".

In this case, it is possible to more surely scoop out the developer contained in the temporary storage chamber. On this account, it is possible to more stably discharge the developer from the second developer discharging opening at higher speed.

A rib which is inclined toward the first developer discharging opening of the developer container may be provided on an outer peripheral surface of the end portion, supported by the container supporting body, of the developer container.

In this case, only by the rotation of the developer container, the rib can convey, toward the temporary storage chamber of the container supporting body, the developer having gotten into a gap between the developer container and the container supporting body.

The container supporting body may be formed by detachably attaching a first case and a second case each other.

Thus, it is possible to easily assemble the developer supplying apparatus, and also possible to do maintenance of the developer supplying apparatus easily.

The embodiments and concrete examples of implementation discussed in the foregoing detailed explanation serve solely to illustrate the technical details of the present technology, which should not be narrowly interpreted within the limits of such embodiments and concrete examples, but rather may be applied in many variations within the spirit of the technology, provided such variations do not exceed the scope of the patent claims set forth below.

What is claimed is:

1. A developer supplying apparatus thr supplying a developer to a developing device, comprising:

a developer container which contains the developer and is in the shape of substantially a cylinder; and a container supporting body which supports one end portion of the developer container so that the developer container is able to rotate in a peripheral surface direction, the developer container including:

a first developer discharging opening for discharging the developer, the first developer discharging opening being formed on said one end portion, supported by the container supporting body, of the developer container; and developer conveying means for conveying the developer toward the first developer discharging opening by rotation of the developer container in the peripheral surface direction, the container supporting body including:

a temporary storage chamber for temporarily storing the developer discharged from the first developer discharging opening of the developer container; and a second developer discharging opening for discharging the developer toward the developing device, the developer contained in the temporary storage chamber being discharged from the second developer discharging opening by the rotation of the developer container, the developer supplying apparatus further comprising a shutter mechanism for opening and closing the second developer discharging opening, the shutter mechanism including:

a shutter member which is slidably provided on the container supporting body and opens/closes the second developer discharging opening; and a hook portion which is provided on the developer container, and when the shutter member is located at such a position that the second developer discharging opening is closed, engages with a part of the shutter member so as to stop the rotation of the developer container.

2. The developer supplying apparatus as set forth in claim 1, wherein when the shutter member is located at such a position that the second developer discharging opening is open, engagement of the hook portion with the part of the shutter member is canceled.

3. The developer supplying apparatus as set forth in claim 1, wherein:

the developer supplying apparatus is detachably attached to an image forming apparatus; and when the developer supplying apparatus is attached to the image forming apparatus, the shutter member slides to such a position that the second developer discharging opening is open.

4. The developer supplying apparatus as set forth in claim 1, wherein:

the shutter member has a regulating member which, when the developer supplying apparatus is attached to an image forming apparatus and the shutter member slides, (i) engages with a protruding portion formed on an attachment portion of the image forming apparatus and (ii) keeps the second developer discharging opening open; and the regulating member has a claw portion which (i) when the shutter member slides in such a direction that the second developer discharging opening is open, engage with the protruding portion and (ii) when a predetermined moving force or more is applied, goes over the protruding portion.

5. The developer supplying apparatus as set forth in claim 4, wherein when the claw portion has gone over the protruding portion, the claw portion regulates sliding of the shutter member in such a direction that the second developer discharging opening is closed.

6. The developer supplying apparatus as set forth in claim 4, wherein the claw portion includes (i) a rib-like first hook portion which first contacts the protruding portion when the shutter member slides in such a direction that the second developer discharging opening opens and (ii) a plate-like second hook portion which contacts the protruding portion after the first hook portion and has elasticity.

7. The developer supplying apparatus as set forth in claim 1, wherein the container supporting body is formed by detachably attaching a first case and a second case each other.

* * * * *